US009857707B2

(12) United States Patent
Tsuda et al.

(10) Patent No.: US 9,857,707 B2
(45) Date of Patent: Jan. 2, 2018

(54) TONER

(71) Applicant: CANON KABUSHIKI KAISHA, Tokyo (JP)

(72) Inventors: Shohei Tsuda, Suntou-gun (JP); Takashi Matsui, Mishima (JP); Satoshi Arimura, Mishima (JP); Kozue Uratani, Mishima (JP); Keisuke Tanaka, Yokohama (JP); Naoki Okamoto, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/923,194

(22) Filed: Oct. 26, 2015

(65) Prior Publication Data

US 2016/0139521 A1 May 19, 2016

(30) Foreign Application Priority Data

Nov. 14, 2014 (JP) ..... 2014-231171
Oct. 19, 2015 (JP) ..... 2015-205384

(51) Int. Cl.
*G03G 9/08* (2006.01)
*G03G 9/09* (2006.01)

(52) U.S. Cl.
CPC ..... *G03G 9/0827* (2013.01); *G03G 9/0819* (2013.01); *G03G 9/0821* (2013.01); *G03G 9/0926* (2013.01)

(58) Field of Classification Search
CPC .. G03G 9/0821; G03G 9/0839; G03G 9/0819; G03G 9/09725; G03G 9/0827
See application file for complete search history.

(56) References Cited

U.S. PATENT DOCUMENTS 5,707,770 A * 1/1998 Tanikawa ..... G03G 13/20 430/108.3
7,014,969 B2 * 3/2006 Yachi ..... G03G 9/08797 423/335
7,625,686 B2 * 12/2009 Ohmura ..... G03G 9/0827 430/109.4
8,232,985 B2 7/2012 Kang et al.
8,455,169 B2 6/2013 Inoue et al.
8,703,378 B2 4/2014 Satoh et al.
(Continued)

FOREIGN PATENT DOCUMENTS

JP 2007-322919 A 12/2007
JP 2011-13441 A 1/2011
(Continued)

OTHER PUBLICATIONS

U.S. Appl. No. 14/943,813, filed Nov. 17, 2015. Inventors: Tanaka, et al.

*Primary Examiner* — Christopher D RoDee
(74) *Attorney, Agent, or Firm* — Fitzpatrick Cella Harper and Scinto

(57) ABSTRACT

Provided is a toner, including: a toner particle containing a binder resin and a colorant; and an inorganic fine particle, in which the toner particle has an average circularity of 0.960 or more, and in which the toner satisfies the formula (1) and the formula (2).

$Fp(A) \leq 25.0$ nN — Formula (1)

$(Fp(B)-Fp(A))/Fp(A) \leq 0.60$ — Formula (2)

11 Claims, 4 Drawing Sheets

(56) References Cited

U.S. PATENT DOCUMENTS

| | | | | |
|---|---|---|---|---|
| 2002/0055052 | A1* | 5/2002 | Komoto | G03G 9/0821 430/108.22 |
| 2003/0134217 | A1* | 7/2003 | Combes | G03G 9/09708 430/108.11 |
| 2010/0261109 | A1* | 10/2010 | Okada | G03G 9/0819 430/105 |
| 2012/0115079 | A1* | 5/2012 | Ikeda | G03G 9/09716 430/108.7 |
| 2015/0185644 | A1* | 7/2015 | Matsui | G03G 9/0819 430/108.3 |
| 2015/0185658 | A1 | 7/2015 | Wakabayashi et al. | |

FOREIGN PATENT DOCUMENTS

| | | | |
|---|---|---|---|
| JP | 2011-133675 | A | 7/2011 |
| JP | 2012-63636 | A | 3/2012 |
| JP | 2012-118541 | A | 6/2012 |

* cited by examiner

TONER

BACKGROUND OF THE INVENTION

Field of the Invention

The present invention relates to a toner to be used in an image-forming method for visualizing an electrostatic charge image in electrophotography.

Description of the Related Art

In recent years, an image-forming apparatus, such as a copying machine or a printer, has been required not only to provide high image quality but also to have both a longer lifetime and a smaller size.

A possible approach to downsizing the image-forming apparatus (in particular, the printer) is a reduction in diameter of a toner carrier or elimination of a supply roller for supplying the toner carrier with a toner. In the case of reducing the diameter of the toner carrier, the toner carrier has an increased curvature, which results in a reduced area of a region of contact between the toner carrier, to which an electric charge is imparted, and a developer-regulating member (hereinafter referred to as "regulating portion"). This condition is severe for imparting the electric charge in the regulating portion. In addition, in the case of eliminating the supply roller, a property of conveying the toner to the toner carrier becomes poor, and hence it is difficult to uniformly convey the toner to the regulating portion. This condition is severe for uniformly imparting the electric charge.

In addition, in recent years, use of the copying machine, the printer, and the like has been rapidly increasing in emerging countries. Countries classified as emerging countries often have an environment having a much higher temperature and a much higher humidity as compared to developed countries. Accordingly, the toner in a cartridge is liable to adsorb moisture, and there is a concern for an adverse effect on an image due to charging failure.

In view of the foregoing, it is necessary to solve problems which may arise when, in the future, a downsized printer is placed under a high-temperature and high-humidity environment and used under various conditions for a long period of time. In this regard, various toner-improving methods have heretofore been proposed.

In Japanese Patent Application Laid-Open No. 2011-13441, it is disclosed that a layered inorganic mineral is added to toner particles to suppress exudation of a release agent to their surfaces, with the result that an inter-toner cohesive force can be reduced and charging performance can be stabilized even in a high-temperature region.

In Japanese Patent Application Laid-Open No. 2007-322919, it is disclosed that when large-particle-diameter silica particles having a sharp particle size distribution obtained by a sol-gel method are used for the toner, stable chargeability can be obtained over a long period of time.

In Japanese Patent Application Laid-Open No. 2012-118541, it is disclosed that the number of silanol groups of large-particle-diameter silica having a sharp particle size distribution is reduced to improve flowability of the toner irrespective of the environment, and thus stable charging performance is obtained.

In Japanese Patent Application Laid-Open No. 2012-63636, it is disclosed that an alkylsilane is used for surface treatment of silica to improve charging performance.

SUMMARY OF THE INVENTION

However, as a result of investigations made by the inventors of the present invention, the toners disclosed in the above-mentioned documents have been found to have the following problems. The toner disclosed in Japanese Patent Application Laid-Open No. 2011-13441 poses a concern for electric charge leakage due to adsorption of moisture by the toner particles or the external additive under a high-humidity environment, and hence may have difficulty in securing a sufficient quantity of electric charges. The large-particle-diameter silica particles obtained by the sol-gel method disclosed in Japanese Patent Application Laid-Open No. 2007-322919 have high hygroscopicity under a high-temperature and high-humidity environment owing to silanol groups on the surfaces of the silica particles, and hence may be unable to secure a high saturation quantity of electric charges. As a result, there is a concern for the aggravation of so-called fogging, which is a phenomenon in which the toner having such low quantity of electric charges is developed onto a non-image region of the image-bearing member. In addition, the large-particle-diameter silica particles migrate into recessed portions of the toner particles after long-term use, and hence it becomes difficult to exhibit an effective function in some cases. The toner disclosed in Japanese Patent Application Laid-Open No. 2012-118541 may migrate into recessed portions of silica through long-term use depending on the shapes of the toner particles, with the result that stable flowability cannot be secured and uniform charging in the regulating portion cannot be secured in some cases. The toner disclosed in Japanese Patent Application Laid-Open No. 2012-63636 may have an insufficient electric charge-imparting ability in the regulating portion under a high-temperature and high-humidity environment as a printer is further downsized. As described above, when long-term use under a high-temperature and high-humidity environment is taken into consideration, there is room for improvement in obtaining a satisfactory charging characteristic.

An object of the present invention is to provide a toner exhibiting a satisfactory fogging-suppressing characteristic over long-term use under a high-temperature and high-humidity environment.

The present invention relates to a toner, including: a toner particle containing a binder resin and a colorant; and an inorganic fine particle, in which the toner particle has an average circularity of 0.960 or more, and in which the toner satisfies the formula (1) and the formula (2):

$$Fp(A) \leq 25.0 \text{ nN} \quad \text{Formula (1)}$$

$$(Fp(B)-Fp(A))/Fp(A) \leq 0.60 \quad \text{Formula (2)}$$

in the formula (1) and the formula (2):

Fp(A) represents an inter-particle force (nN) of the toner, which is measured by using a consolidated body of the toner prepared by compressing the toner with a load of 78.5 N; and Fp(B) represents an inter-particle force (nN) of the toner, which is measured by using a consolidated body of the toner prepared by compressing the toner with a load of 157.0 N.

Further features of the present invention will become apparent from the following description of exemplary embodiments with reference to the attached drawings.

DESCRIPTION OF THE EMBODIMENTS

Figure 1A:
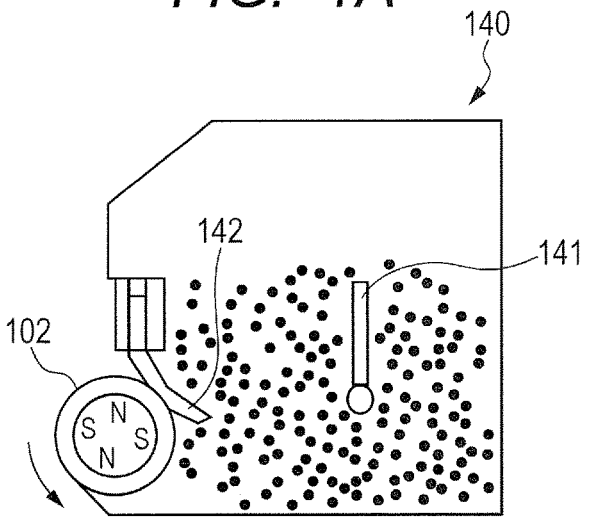
FIG. 1A is an illustration of an example of an image-forming apparatus.

Preferred embodiments of the present invention will now be described in detail in accordance with the accompanying drawings.

Under a high-temperature and high-humidity environment, the adsorption of moisture by toner particles or an external additive causes the leakage of an electric charge imparted to a toner at a regulating portion, thereby lowering the buildup and saturated values of the quantity of electric charges. As a result, there occurs so-called fogging, which is a phenomenon in which the toner having such low quantity of electric charges is developed onto a non-image region of an electrostatic latent image-bearing member.

The fogging is particularly significant in image output immediately after restart on the day after the stop of a printer, and this so-called "first fogging in the morning" is caused by the lack of the buildup of the quantity of electric charges of the toner. In addition, under a situation in which a toner cartridge is stored for a long period of time or under a situation in which the external additive is buried and packed, for example, after long-term use, the toner brought into a consolidated state in the cartridge cannot be instantly loosened. As a result, image output immediately after the start of the printer involves a risk of a further lack of charge buildup performance, leading to significant first fogging in the morning.

Charging in the regulating portion is caused by rubbing between a regulating blade and the toner particles. When the toner is supplied from a developing device to precoat a toner carrier and enters the regulating portion, the toner is present in a state of being aggregated to some degree.

The inventors of the present invention have made extensive investigations, and as a result, have found that when the aggregated toner can be instantly loosened, the toner forms a thin-layer coating and the toner regulated onto the toner carrier can be uniformly charged. The inventors have also found that in order to reduce the aggregating property of the toner, it is necessary to increase the flowability of the toner.

As a result of further investigations, it has been found that the flowability of the toner can be increased by reducing an inter-particle force between the toner particles. It has also been found that through the control of the inter-particle force between the toner particles, the toner can be instantly loosened immediately before entering the regulating portion to improve the charge buildup performance of the toner.

As a result, even after long-term storage after endurance under a high-temperature and high-humidity environment, which is a condition under which the toner is extremely difficult to loosen, the charge buildup performance has been able to be improved to ameliorate the first fogging in the morning.

In addition, when the average circularity of toner particles is controlled to 0.960 or more, the flowability of the toner particles alone can also be increased. Consequently, a mixing property with silica fine particles in an external addition step is satisfactory and the silica fine particles are externally added to the surfaces of the toner particles in a uniform manner. In addition, the surfaces of the toner particles have fewer recessed portions, and hence the external additive does not migrate even after long-term use and maintains a uniform external addition state even in long-term use.

Further, when the inter-particle force and the average circularity of the toner particles are simultaneously controlled, there is obtained a state in which adjacent toner particles in a toner thin layer present in the regulating portion are brought into point contact through the intermediation of the external additive. It has been found that as a result of the foregoing, the surface area of the external additive on the toner particles contributing to charging in the regulating portion can be increased. It has also been found that when the inter-particle force and the average circularity are simultaneously controlled, the point contact state can be maintained even through long-term use, and hence even when packed to a highly consolidated state as in long-term storage after long-term use, the toner is easily loosened in the regulating portion. It is considered that as a result, more charging sites in the regulating portion can be gained through long-term use, and more uniform imparting of an electric charge and higher charge buildup performance than ever before can be achieved.

In view of the foregoing, a toner according to one embodiment for achieving the object of the present invention has the following features. That is, the toner particle has an average circularity of 0.960 or more, and the toner satisfies the formula (1) and the formula (2):

$$Fp(A) \leq 25.0 \text{ nN} \quad \text{Formula (1)}$$

$$(Fp(B)-Fp(A))/Fp(A) \leq 0.60 \quad \text{Formula (2)}$$

in the formula (1) and the formula (2): Fp(A) represents an inter-particle force (nN) of the toner, which is measured by using a consolidated body of the toner prepared by compressing the toner with a load of 78.5 N; and Fp(B) represents an inter-particle force (nN) of the toner, which is measured by using a consolidated body of the toner prepared by compressing the toner with a load of 157.0 N.

When the average circularity of the toner particles is less than 0.960, under a situation in which the toner cartridge is stored for a long period of time to be packed, the state in which adjacent toner particles are brought into point contact through the intermediation of the external additive becomes infinitely rare. As a result, the toner particles are brought into contact with each other, and hence uniform chargeability and a high saturation quantity of electric charges cannot be obtained, with the result that the first fogging in the morning is liable to occur. In addition, when the average circularity of the toner particles is less than 0.960 and monodispersed spherical silica or the like is used as a large-particle-diameter external additive, the external additive rolls into recessed portions owing to long-term use to prevent the exhibition of its effect as spacer particles, and thus it is difficult to gain charging sites. Besides, owing to the contact between the toner particles, the inter-particle force cannot be controlled, with the result that the first fogging in the morning is liable to occur.

In addition, the average circularity of the toner particles is more preferably 0.970 or more. When the average circularity of the toner particles is 0.970 or more, the shape of the toner is a spherical shape or a shape similar thereto, resulting in excellent flowability, a quick charge buildup, and ease of obtaining uniform chargeability. In addition, the point contact state between the adjacent toner particles through the intermediation of the external additive becomes more common, and hence the surface area of the external additive contributing to charging in the regulating portion can be increased. Consequently, the first fogging in the morning under a high-temperature and high-humidity environment is easily ameliorated and high developability is easily maintained even in the latter period of long-term use. Therefore, the average circularity of 0.970 or more is preferred.

Besides, the migration of the external additive into the recessed portions does not occur, and even in the latter period of long-term use, the external additive can function as spacer particles, with the result that high developability is easily maintained.

In addition, in the present invention, the toner satisfies the formula (1) and the formula (2). Fp(A) and Fp(B) in the formula (1) and the formula (2) represent inter-particle forces calculated based on maximum tensile fracture forces when a vertically separating cell is fractured after the application of loads of 78.5 N (A) and 157.0 N (B) to the toner contained in the cell.

Herein, the compression conditions of 78.5 N (A) and 157.0 N (B) are values determined on the assumption of loads to be applied when a consolidated toner in a process cartridge passes through the regulating portion.

In recent years, on the assumption of the downsizing of a printer, a toner carrier having an outer diameter of from about 10 mmϕ (diameter of 10 mm) to about 14 mmϕ has been commonly used. A torque to be applied to such small-diameter toner carrier is from about 0.1 N·m to about 0.3 N·m on its axis. This means that a load of from about 20 N to about 60 N is applied between the surface of the toner carrier and the regulating blade. When the diameter of the toner carrier is further reduced, a load higher than the above-mentioned one is predicted to be applied in the regulating portion.

Therefore, the load of 78.5 N (A) is a value determined on the assumption of a construction in which a load stronger than a related-art load by about 20% is applied in consideration of the reduction in diameter of the toner carrier and on the assumption of the entrance of a deteriorated toner after endurance into the regulating portion. Meanwhile, the load of 157.0 N (B) is a value determined on the assumption of a state in which the flowability of the toner is halved in a cartridge construction including the toner carrier reduced in diameter as described above, i.e., a state in which the toner is deteriorated owing to long-term use and is further consolidated. As described above, a large load may be applied when the extremely consolidated toner in the process cartridge after long-term storage after long-term use enters the regulating portion.

It has been found that when Fp(A) is 25.0 nN ($2.5\times10^{-8}$ N) or less, satisfactory charge buildup performance is obtained at the time of so-called "first printing in the morning," which is image output immediately after restart after long-term storage after long-term use. The inventors of the present invention presume the reason for this to be as described below.

When Fp(A) is 25.0 nN or less, in the regulating portion in the process cartridge, adjacent toner particles can be present in a state similar to point contact through the intermediation of the external additive. It is considered that when such state is obtained, the external additive effectively serves as a charging site and a uniform electric charge distribution can be obtained. As a result, even at the time of the first printing in the morning, when it is difficult to secure the quantity of electric charges, satisfactory charge buildup performance is obtained, and the first fogging in the morning is considered to be thus ameliorated.

On the other hand, when Fp(A) is more than 25.0 nN, in the regulating portion after long-term use, a state in which adjacent toner particles are brought into contact with each other starts to occur, and the point contact state through the intermediation of the external additive becomes difficult to obtain. As a result, the toner cannot be instantly loosened in the regulating portion. Consequently, a uniform electric charge distribution and satisfactory charge buildup performance are not obtained, and the first fogging in the morning is considered to be thus aggravated.

In addition, when (Fp(B)−Fp(A))/Fp(A) is 0.60 or less, when a printer is restarted with the toner after long-term storage after long-term use, an aggregate of the toner can be easily loosened immediately before entering the regulating portion, and satisfactory charge buildup performance is obtained. The reason for this is presumed to be as described below.

The toner in the process cartridge after long-term storage after long-term use is in a more consolidated state than the consolidated state of a toner immediately after long-term use. When Fp(B), which represents this state, falls within a region in which a relationship of (Fp(B)−Fp(A))/Fp(A) ≤0.60 is satisfied, adjacent toner particles in a toner layer in a highly consolidated state are considered to keep the point contact of the external additive and the toner particles to some degree. As a result, the highly consolidated state of the toner after long-term storage after long-term use can be easily released to some degree by a stirring blade in the cartridge when the printer is restarted.

On the other hand, when (Fp(B)−Fp(A))/Fp(A) is more than 0.60, it is considered that contact between adjacent toner particles starts to occur and the embedment of the external additive occurs, with the result that the point contact with the external additive hardly occurs. As a result, the toner cannot be instantly loosened in the regulating portion, a uniform electric charge distribution and satisfactory charge buildup performance are not obtained, and the first fogging in the morning is aggravated.

As described above, it is considered that through simultaneous control of Fp(A) and Fp(B), the first fogging in the morning can be ameliorated even under a harsh condition like long-term use since an initial stage or long-term storage after long-term use.

Next, components to be contained in the toner of the present invention are described.

First, a colorant is described.

Carbon black may be used as a black colorant, and ones toned to various colors through the use of yellow/magenta/cyan colorants described below may be utilized. Toner particles of the present invention preferably contain magnetic fine particles (magnetic material). In the present invention, the magnetic fine particles may double as the colorant.

In order to obtain a uniform adhesion property and a high sticking property of silica fine particles A to be described later, it is more preferred to use a magnetic toner which uses magnetic fine particles. The magnetic toner contains the magnetic fine particles, and hence has a large specific gravity as compared to a non-magnetic toner. The inventors of the present invention presume the reason why the high sticking property is obtained to be as described below. As a method of allowing an external additive to adhere to toner particles, there is used a mixing apparatus using a stirring blade or the like from the viewpoints of a mixing property and a shearing force. In such external addition step, a site in which the treatment is mainly performed is the vicinity of the stirring blade. In the vicinity of the stirring blade, a load on the non-magnetic toner having a small specific gravity at the time of external addition treatment becomes small in some cases. On the other hand, the magnetic toner having a large specific gravity is subjected to a large load at the time of the external addition treatment in the vicinity of the stirring blade as compared to the non-magnetic toner, and is considered to have a high probability of being more treated. Therefore, the magnetic toner is considered to be capable of achieving a higher sticking property than the non-magnetic toner.

The magnetic fine particles to be used in the toner of the present invention contain a magnetic iron oxide, such as triiron tetroxide or γ-iron oxide, as a main component, and may contain an element such as phosphorus, cobalt, nickel, copper, magnesium, manganese, aluminum, or silicon. The magnetic fine particles have a BET specific surface area measured by a nitrogen adsorption method of preferably from 2 $m^2/g$ to 30 $m^2/g$, more preferably from 3 $m^2/g$ to 28 $m^2/g$. In addition, the magnetic fine particles preferably have a Mohs hardness of from 5 to 7. Examples of the shape of each of the magnetic fine particles include a polyhedral shape, an octahedral shape, a hexahedral shape, a spherical shape, a needle shape, and a scaly shape. Of those, a shape with a low degree of anisotropy, such as a polyhedral shape, an octahedral shape, a hexahedral shape, or a spherical shape, is preferred in order to increase an image density.

The magnetic fine particles preferably have a number average particle diameter of from 0.10 μm to 0.40 μm. When the number average particle diameter is 0.10 μm or more, the magnetic fine particles hardly agglomerate, and hence the uniform dispersibility of the magnetic fine particles in the toner is improved. In addition, the magnetic fine particles having a number average particle diameter of 0.40 μm or less are preferably used because the coloring power of the toner is improved.

It should be noted that the number average particle diameter of the magnetic fine particles may be measured with a transmission electron microscope. Specifically, the toner particles to be observed are sufficiently dispersed in an epoxy resin, and then the resultant is cured in an atmosphere having a temperature of 40° C. for 2 days so that a cured product is obtained. The resultant cured product is turned into a flaky sample with a microtome, and then the sample is photographed with a transmission electron microscope (TEM) at a magnification of from 10,000 to 40,000. The diameters of 100 magnetic fine particles in the field of view of the photograph are measured. Then, the number average particle diameter is calculated based on the equivalent diameter of a circle equal in area to the projected area of the magnetic fine particles. Alternatively, the particle diameters may be measured with an image analyzer.

The magnetic fine particles to be used in the toner of the present invention may be produced by, for example, the following method. An alkali, such as sodium hydroxide, is added to an aqueous solution of a ferrous salt in an equivalent or more with respect to the iron component so that an aqueous solution containing ferrous hydroxide is prepared. While the pH of the prepared aqueous solution is maintained at pH 7 or more, air is blown into the aqueous solution. Then, the oxidation reaction of ferrous hydroxide is performed while the aqueous solution is heated to 70° C. or more. Thus, a seed crystal serving as the core of magnetic iron oxide powder is produced first.

Next, an aqueous solution containing about one equivalent of ferrous sulfate with reference to the addition amount of the alkali previously added is added to the slurry-like liquid containing the seed crystal. While the pH of the resultant liquid is maintained at from 5 to 10, air is blown into the liquid. During the blowing, the reaction of ferrous hydroxide is advanced so that the magnetic iron oxide powder is grown with the seed crystal as a core. At this time, the shape and magnetic characteristics of the magnetic fine particles may be controlled by selecting an arbitrary pH, an arbitrary reaction temperature, and an arbitrary agitation condition. As the oxidation reaction progresses, the pH of the liquid shifts to acidic values. However, the pH of the liquid is preferably prevented from becoming less than 5. The magnetic fine particles thus obtained are filtered, washed, and dried by ordinary methods. Thus, the magnetic fine particles can be obtained.

In addition, when the toner is produced by a suspension polymerization method, the surfaces of the magnetic fine particles are extremely preferably subjected to hydrophobic treatment. When the surfaces are treated by a dry process, the magnetic fine particles which have been washed, filtered, and dried are subjected to treatment with a silane compound or treatment with a coupling agent. When the surfaces are treated by a wet process, the dried product after the completion of the oxidation reaction is re-dispersed, or the iron oxide body obtained by the washing and filtration after the completion of the oxidation reaction is re-dispersed in another aqueous medium without being dried, followed by treatment with a silane compound or coupling treatment. Specifically, the treatment with a silane compound or the coupling treatment is performed by adding a silane compound or a silane coupling agent while sufficiently agitating the re-dispersion liquid, and hydrolyzing the compound or the agent and then increasing the temperature of the re-dispersion liquid or hydrolyzing the compound or the agent and then adjusting the pH of the dispersion liquid to an alkali region. The surface treatment is preferably performed by the following method out of such methods as described above from such a viewpoint that the surface treatment is uniformly performed. After the completion of the oxidation reaction, the resultant is filtered and washed, and is then directly turned into slurry without being dried.

The term "aqueous medium" as used herein refers to a medium mainly formed of water. Specific examples thereof include water itself, a medium obtained by adding a small amount of a surfactant to water, a medium obtained by adding a pH adjustor to water, and a medium obtained by adding an organic solvent to water. A nonionic surfactant, such as polyvinyl alcohol, is preferably used as the surfactant. The surfactant is preferably added in an amount of from 0.1 mass % to 5.0 mass % with respect to water. Examples of the pH adjustor include inorganic acids such as hydrochloric acid. Examples of the organic solvent include alcohols.

As a surface treatment agent which may be used in the surface treatment of the magnetic fine particles, there are given, for example, a silane compound, a silane coupling agent, and a titanium coupling agent. Of those, a silane compound or a silane coupling agent represented by the formula (3) is more preferably used.

$$R_mSiY_n \qquad \text{Formula (3)}$$

[In the formula, R represents an alkoxy group, m represents an integer of from 1 to 3, Y represents a functional group such as an alkyl group, a vinyl group, an epoxy group, or a (meth)acrylic group, and n represents an integer of from 1 to 3, provided that m+n=4.]

Examples of the silane compound or silane coupling agent represented by the formula (3) may include: a silane coupling agent, such as vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-γ-aminopropyltrimethoxysilane, methacryloxypropyltrimethoxysilane, or vinyltriacetoxysilane; and a silane compound, such as methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hyroxypropyltrimethoxysilane, n-hexadecyltrimethoxysilane, or n-octadecyltrimethoxysilane.

Of those, a silane compound represented by the formula (4) is preferably used from such a viewpoint that high hydrophobicity is imparted to the magnetic fine particles.

$$C_pH_{2p+1}—Si—(OC_qH_{2q+1})_3 \qquad \text{Formula (4)}$$

[In the formula, p represents an integer of from 2 to 20 and q represents an integer of from 1 to 3.]

When the silane compound or the silane coupling agent is used, the magnetic fine particles may be treated with one kind of the compounds or the agents alone, or may be treated with a plurality of kinds thereof in combination. When a plurality of kinds thereof are used in combination, the magnetic fine particles may be treated with each of the silane compounds or the silane coupling agents individually, or may be treated with the compounds or the agents simultaneously.

In the present invention, a colorant other than the magnetic fine particles may be used together. Examples of the colorant which may be used together include, in addition to the above-mentioned known dyes and pigments, magnetic or non-magnetic inorganic compounds. Specific examples thereof include: particles of ferromagnetic metals, such as cobalt and nickel; alloys thereof obtained by adding chromium, manganese, copper, zinc, aluminum, rare-earth elements, and the like thereto; particles such as hematite; titanium black; nigrosine dyes/pigments; carbon black; and phthalocyanine.

The content of the magnetic fine particles in the toner particles is from 20 parts by mass to 200 parts by mass with respect to 100 parts by mass of a polymerizable monomer or a binder resin, particularly preferably from 40 parts by mass to 150 parts by mass with respect to 100 parts by mass of the polymerizable monomer or the binder resin.

As a yellow colorant, there are given compounds typified by condensed azo compounds, isoindolinone compounds, anthraquinone compounds, azo metal complexes, methine compounds, and allylamide compounds. A specific example thereof is C.I. Pigment Yellow 12, 13, 14, 15, 17, 62, 73, 74, 83, 93, 94, 95, 97, 109, 110, 111, 120, 128, 129, 138, 147, 150, 151, 154, 155, 168, 180, 185, or 214.

As a magenta colorant, there are given condensed azo compounds, diketopyrrolopyrrole compounds, anthraquinone, quinacridone compounds, basic dye lake compounds, naphthol compounds, benzimidazolone compounds, thioindigo compounds, and perylene compounds. Specific examples thereof include C.I. Pigment Red 2, 3, 5, 6, 7, 23, 48:2, 48:3, 48:4, 57:1, 81:1, 122, 146, 166, 169, 177, 184, 185, 202, 206, 220, 221, 238, 254, or 269, and C.I. Pigment Violet 19.

As a cyan colorant, there are given copper phthalocyanine compounds and derivatives thereof, anthraquinone compounds, and basic dye lake compounds. A specific example thereof is C.I. Pigment Blue 1, 7, 15, 15:1, 15:2, 15:3, 15:4, 60, 62, or 66.

Those colorants may each be used alone, or two or more kinds thereof may be used as a mixture or a solid solution. The colorant is appropriately selected in view of hue angle, chroma saturation, brightness, lightfastness, OHP transmissivity, and dispersibility in toner. The addition amount of the colorant to be used is preferably from 1 part by mass to 20 parts by mass with respect to 100 parts by mass of the polymerizable monomer or the binder resin.

Next, the binder resin is described.

Examples of the binder resin include polyester, a vinyl-based resin, an epoxy resin, and polyurethane.

An alcohol component and an acid component which may be used in the synthesis of the polyester are as described below.

Of the alcohol components, a dihydric alcohol component is exemplified by an aliphatic diol and an aromatic diol.

Examples of the aliphatic diol include ethylene glycol, diethylene glycol, triethylene glycol, 1,2-propylene glycol, 1,3-propylene glycol, dipropylene glycol, 1,4-butanediol, 1,4-butadiene glycol, trimethylene glycol, tetramethylene glycol, pentamethylene glycol, hexamethylene glycol, octamethylene glycol, nonamethylene glycol, decamethylene glycol, and neopentyl glycol. When the aliphatic diol is contained, in some cases, the polyester molecules have crystalline portions in which molecules are aligned. It is preferred that the aliphatic diol be contained in an amount of 50% or more of all alcohol components.

Examples of the aromatic diol include a bisphenol represented by the formula (5) and a derivative thereof and a diol represented by the formula (6).

Formula (5)

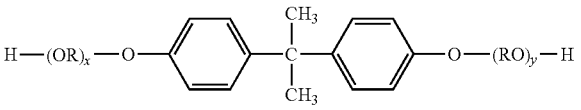

(In the formula, R represents an ethylene group or a propylene group, x and y each represent an integer of 1 or more, and the average of x+y is from 2 to 10.)

Formula (6)

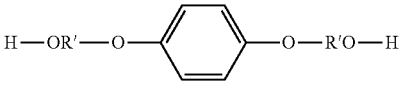

(In the formula, R' represents

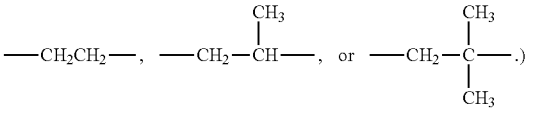

.)

Of the acid components, a divalent acid component is exemplified by dicarboxylic acids and derivatives thereof, such as: benzene dicarboxylic acids, such as phthalic acid, terephthalic acid, isophthalic acid, and phthalic anhydride, anhydrides thereof, or lower alkyl esters thereof; alkyldicarboxylic acids, such as succinic acid, adipic acid, sebacic acid, and azelaic acid, anhydrides thereof, or lower alkyl esters thereof; alkenylsuccinic acids or alkylsuccinic acids, such as n-dodecenylsuccinic acid and n-dodecylsuccinic acid, anhydrides thereof, or lower alkyl esters thereof; and unsaturated dicarboxylic acids, such as fumaric acid, maleic acid, citraconic acid, and itaconic acid, anhydrides thereof, or lower alkyl esters thereof.

In the present invention, a polyester obtained by subjecting a carboxylic acid component containing 90 mol % or more of an aromatic carboxylic acid compound and an alcohol component to condensation polymerization, 80 mol % or more of the aromatic carboxylic acid compound being terephthalic acid and/or isophthalic acid, is preferred.

In addition, as the alcohol component or the acid component, a trihydric or higher alcohol component or a trivalent or higher acid component serving as a crosslinking component may be used in combination with the dihydric alcohol component or the divalent acid component.

As a polyhydric alcohol component which is trihydric or higher, there are given: sorbitol; 1,2,3,6-hexanetetrol; 1,4-sorbitan; pentaerythritol; dipentaerythritol; tripentaerythritol; 1,2,4-butanetriol; 1,2,5-pentanetriol; glycerol; 2-methyl propanetriol; 2-methyl-1,2,4-butanetriol; trimethylolethane; trimethylolpropane; and 1,3,5-trihydroxybenzene.

As a polyvalent carboxylic acid component which is trivalent or higher, there are given trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, and an enpol trimer acid, and anhydrides thereof.

The alcohol component is used in an amount of preferably from 40 mol % to 60 mol %, more preferably from 45 mol % to 55 mol % with respect to the total of the acid component and the alcohol component.

The polyester resin is typically obtained by generally known condensation polymerization.

Meanwhile, an example of the vinyl-based resin is a styrene-based resin.

Specific examples of the styrene-based resin include polystyrene and styrene-based copolymers, such as a styrene-propylene copolymer, a styrene-vinyltoluene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-octyl methacrylate copolymer, a styrene-butadiene copolymer, a styrene-isoprene copolymer, a styrene-maleic acid copolymer, and a styrene-maleate copolymer. Those styrene-based resins may each be used alone, or a plurality of kinds thereof may be used in combination.

The following monomers are given as monomers for generating the styrene-based resin.

For example, there are given: styrene; derivatives of styrene, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; unsaturated monoolefins, such as ethylene, propylene, butylene, and isobutylene; unsaturated polyenes, such as butadiene and isoprene; vinyl halides, such as vinyl chloride, vinylidene chloride, vinyl bromide, and vinyl fluoride; vinyl esters, such as vinyl acetate, vinyl propionate, and vinyl benzoate; α-methylene aliphatic monocarboxylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinylpyrrolidone; vinylnaphthalenes; and acrylic acid or methacrylic acid derivatives, such as acrylonitrile, methacrylonitrile, and acrylamide.

Further, there are given: unsaturated dibasic acids, such as maleic acid, citraconic acid, itaconic acid, an alkenylsuccinic acid, fumaric acid, and mesaconic acid; unsaturated dibasic acid anhydrides, such as maleic anhydride, citraconic anhydride, itaconic anhydride, and an alkenylsuccinic anhydride; unsaturated dibasic acid half esters, such as a methyl maleate half ester, an ethyl maleate half ester, a butyl maleate half ester, a methyl citraconate half ester, an ethyl citraconate half ester, a butyl citraconate half ester, a methyl itaconate half ester, a methyl alkenylsuccinate half ester, a methyl fumarate half ester, and a methyl mesaconate half ester; unsaturated dibasic acid esters, such as dimethyl maleate and dimethyl fumarate; α,β-unsaturated acids, such as acrylic acid, methacrylic acid, crotonic acid, and cinnamic acid; α,β-unsaturated acid anhydrides, such as crotonic anhydride and cinnamic anhydride, and anhydrides of the α,β-unsaturated acids and lower fatty acids; and monomers each having a carboxyl group, such as an alkenylmalonic acid, an alkenylglutaric acid, and an alkenyladipic acid, and acid anhydrides thereof and monoesters thereof.

Further, there are given: acrylic acid esters and mathacrylic acid esters, such as 2-hydroxyethyl acrylate, 2-hydroxyethyl methacrylate, and 2-hydroxypropyl methacrylate; and monomers each having a hydroxy group, such as 4-(1-hydroxy-1-methylbutyl)styrene and 4-(1-hydroxy-1-methylhexyl)styrene.

It should be noted that the binder resin of the toner of the present invention is preferably a styrene-based resin.

Of those, a styrene-butyl acrylate copolymer or a styrene-butyl methacrylate copolymer is particularly preferred because its degree of branching and resin viscosity are easily adjusted and hence developability is easily maintained over a long period of time.

In addition, the binder resin to be used for the toner of the present invention is preferably a styrene-based resin, and any of the following resins may be used in combination therewith to the extent that the effect of the present invention is not impaired.

For example, there may be used polymethyl methacrylate, polybutyl methacrylate, polyvinyl acetate, polyethylene, polypropylene, polyvinyl butyral, a silicone resin, a polyester resin, a polyamide resin, an epoxy resin, and a polyacrylic acid resin. Those resins may each be used alone, or a plurality of kinds thereof may be used in combination, in combination with the styrene-based resin.

In the toner of the present invention, the vinyl-based resin serving as the binder resin may have a crosslinked structure crosslinked with a crosslinking agent having two or more vinyl groups. For example, the following crosslinking agents are used.

As aromatic divinyl compounds, there are given, for example, divinylbenzene and divinylnaphthalene.

As diacrylate compounds bonded by alkyl chains, there are given, for example, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and those obtained by changing the acrylates of the above-mentioned compounds to methacrylates.

As diacrylate compounds bonded by alkyl chains each containing an ether bond, there are given, for example, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those obtained by changing the acrylates of the above-mentioned compounds to methacrylates.

As diacrylate compounds bonded by chains each containing an aromatic group and an ether bond, there are given, for example, polyoxyethylene(2)-2,2-bis(4-hydroxyphenyl)propane diacrylate, polyoxyethylene(4)-2,2-bis(4-hydroxyphenyl)propane diacrylate, and those obtained by changing the acrylates of the above-mentioned compounds to methacrylates.

As a polyester-type diacrylate compound, there is given, for example, a product available under the trade name MANDA (Nippon Kayaku Co., Ltd.).

In addition, as polyfunctional crosslinking agents, there are given: pentaerythritol triacrylate, trimethylolethane triacrylate, trimethylolpropane triacrylate, tetramethylolmethane tetraacrylate, oligoester acrylate, and those obtained by changing the acrylate of the above-mentioned compounds to methacrylate; triallyl cyanurate; and triallyl trimellitate.

Of those crosslinkable monomers, aromatic divinyl compounds (in particular, divinylbenzene) and diacrylate compounds bonded by chains each containing an aromatic group and an ether bond are given as ones to be suitably used from the viewpoint of an improvement in durability.

The binder resin according to the present invention preferably has a glass transition temperature (Tg) of from 45° C. to 70° C. When the Tg is 45° C. or more, developability is easily improved over a long period of time, and when the Tg is 70° C. or less, low-temperature fixability tends to be improved, which is preferred.

The toner of the present invention may contain a release agent.

Examples of the release agent include: waxes each having a fatty acid ester as a main component, such as a carnauba wax and a montanic acid ester wax; and those obtained by subjecting part or the whole of the acid components of fatty acid esters to deacidification, such as a deacidified carnauba wax; methyl ester compounds each having a hydroxyl group obtained by hydrogenation of vegetable oils and fats; saturated fatty acid monoesters, such as stearyl stearate and behenyl behenate; diesterfied products of saturated aliphatic dicarboxylic acids and saturated aliphatic alcohols, such as dibehenyl sebacate, distearyl dodecanedioate, and distearyl octadecanedioate; and diesterfied products of saturated aliphatic diols and saturated fatty acids, such as nonanediol dibehenate and dodecanediol distearate; aliphatic hydrocarbon-based waxes, such as low-molecular weight polyethylene, low-molecular weight polypropylene, a microcrystalline wax, a paraffin wax, and a Fischer-Tropsch wax; oxides of aliphatic hydrocarbon-based waxes, such as a polyethylene oxide wax, or block copolymers thereof; and waxes obtained by grafting aliphatic hydrocarbon-based waxes with vinyl-based monomers, such as styrene and acrylic acid; saturated linear fatty acids, such as palmitic acid, stearic acid, and montanic acid; unsaturated fatty acids, such as brassidic acid, eleostearic acid, and parinaric acid; saturated alcohols, such as stearyl alcohol, aralkyl alcohol, behenyl alcohol, carnaubyl alcohol, ceryl alcohol, and melissyl alcohol; polyhydric alcohols, such as sorbitol; fatty acid amides such as linoleic acid amide, oleic acid amide, and lauric acid amide; saturated fatty acid bisamides, such as methylenebis(stearic acid amide), ethylenebis(capric acid amide), ethylenebis(lauric acid amide), and hexamethylenebis(stearic acid amide); unsaturated fatty acid amides, such as ethylenebis(oleic acid amide), hexamethylenebis(oleic acid amide), N,N'-dioleyl adipic acid amide, and N,N'-dioleyl sebacic acid amide; aromatic bisamides such as m-xylenebis(stearic acid amide) and N,N'-distearyl isophthalic acid amide; aliphatic metal salts (generally referred to as metal soaps), such as calcium stearate, calcium laurate, zinc stearate, and magnesium stearate; and long-chain alkyl alcohols or long-chain alkyl carboxylic acids each having 12 or more carbon atoms.

Of those release agents, monofunctional or bifunctional ester waxes, such as saturated fatty acid monoesters and diesterified products, and hydrocarbon waxes, such as a paraffin wax and a Fisher-Tropsch wax, are preferred.

The melting point of the release agent defined by the peak temperature of a maximum endothermic peak at the time of a temperature increase measured with a differential scanning calorimeter (DSC) is preferably from 60° C. to 140° C., more preferably from 60° C. to 90° C. When the melting point is 60° C. or more, the storage stability of the toner of the present invention is improved. Meanwhile, when the melting point is 140° C. or less, the low-temperature fixability is easily improved, which is preferred.

The content of the release agent is preferably from 3 parts by mass to 30 parts by mass with respect to 100 parts by mass of the binder resin.

The toner of the present invention preferably contains a charge control agent.

An organic metal complex compound or a chelate compound is effectively used as a charge control agent for negative charging. Examples thereof include: a monoazo metal complex compound; an acetylacetone metal complex compound; and a metal complex compound of an aromatic hydroxycarboxylic acid or an aromatic dicarboxylic acid.

As specific examples of commercially available products thereof, there are given Spilon Black TRH, T-77, or T-95 (Hodogaya Chemical Co., Ltd.) and BONTRON (trademark) S-34, S-44, S-54, E-84, E-88, or E-89 (manufactured by Orient Chemical Industries Co., Ltd.).

Those charge control agents may each be used alone, or two or more kinds thereof may be used in combination. From the viewpoint of the quantity of electric charges of the toner, the charge control agent is used in an amount of preferably from 0.1 part by mass to 10.0 parts by mass, more preferably from 0.1 part by mass to 5.0 parts by mass with respect to 100 parts by mass of the binder resin.

In the present invention, inorganic fine particles preferably contain silica fine particles A.

It is preferred from the viewpoint of the ease of controlling the particle size distribution that the silica fine particles A be silica fine particles produced by a sol-gel method. The sol-gel method is a method involving forming particles through solvent removal from, and drying of, a silica sol suspension liquid obtained by subjecting an alkoxysilane to a hydrolysis and condensation reaction with a catalyst in a water-containing organic solvent.

The silica fine particles obtained by the sol-gel method have appropriate particle diameters and a narrow particle size distribution and are monodispersed and spherical. Accordingly, the silica fine particles are uniformly dispersed on the surfaces of the toner particles with ease and can reduce the inter-particle force by virtue of a stable spacer effect.

The silica fine particles A preferably have a number average particle diameter (D1) of primary particles of from 80 nm to 200 nm from the viewpoints of the control of a sticking ratio and an effect as spacer particles through long-term use. Further, the silica fine particles A preferably have a half width of the maximum peak in the weight-based particle size distribution of primary particles of 25 nm or less.

The sol-gel silica obtained by the sol-gel method is present in a spherical and monodispersed form, but part of the sol-gel silica is present in a coalesced form. When the half width in the weight-based particle size distribution is 25 nm or less, the amount of such coalesced particles is small, and the uniform adhesion property of the silica fine particles A on the surfaces of the toner particles is increased, with the result that higher flowability is obtained. As a result, the uniform chargeability and the charge buildup performance of the toner are further improved. This effect becomes more significant in the case of toner particles having an average circularity of 0.960 or more or toner particles having an aspect ratio of 0.900 or more.

Further, the silica fine particles A have a saturated moisture adsorption amount of preferably from 0.4 mass % to 3.0 mass % after being left to stand under an environment having a temperature of 32.5° C. and a relative humidity of 80% for 2 hours.

When the saturated moisture adsorption amount is controlled to the above-mentioned range, sol-gel silica having pores hardly adsorbs moisture even under a high-temperature and high-humidity environment and high chargeability is easily maintained. Accordingly, an image having higher image quality with less fogging can be obtained through long-term use.

Next, a production method for silica fine particles based on the sol-gel method is described below. First, in a water-containing organic solvent, an alkoxysilane is subjected to a hydrolysis and condensation reaction with a catalyst to provide a silica sol suspension liquid. Then, the solvent is removed from the silica sol suspension liquid and the residue is dried. Thus, the silica fine particles are obtained. The number average particle diameter of the primary particles of the silica fine particles obtained by the sol-gel method may be controlled based on a reaction temperature, a rate at which the alkoxysilane is added dropwise, a weight ratio among water, the organic solvent, and the catalyst, and a stirring speed in the hydrolysis and condensation reaction step. For example, as the reaction temperature increases, the number average particle diameter of the primary particles of the silica fine particles tends to become smaller.

The silica fine particles to be thus obtained are generally hydrophilic and have many surface silanol groups. Accordingly, in the case of using the silica fine particles as an external additive for the toner, their surfaces are preferably subjected to hydrophobizing treatment.

As a method for the hydrophobizing treatment of the silica fine particles, there are given a method involving, after removing the solvent from the silica sol suspension liquid and drying the residue, treating the resultant with a hydrophobizing treatment agent, and a method involving directly adding a hydrophobizing treatment agent to the silica sol suspension liquid to perform the treatment simultaneously with the drying. From the viewpoints of the control of the half width in the particle size distribution of the silica fine particles A, and the control of the saturated moisture adsorption amount, a technique involving directly adding a hydrophobizing treatment agent to the silica sol suspension liquid is preferred. Through the hydrophobizing treatment in the suspension liquid, the sol-gel silica can be subjected to the hydrophobizing treatment while being present in a monodispersed form, and hence an aggregate mass is hardly generated after the drying and uniform coating can be performed.

In addition, the pH of the silica sol suspension liquid is more preferably acidic. When the suspension liquid is acidic, reactivity with the hydrophobizing treatment agent is increased, and stronger and more uniform hydrophobizing treatment can be performed.

Examples of the hydrophobing agent include γ-(2-aminoethyl)aminopropyltrimethoxysilane, γ-(2-aminoethyl) aminopropylmethyldimethoxysilane, γ-methacryloxypropyltrimethoxysilane, N-β-(N-vinylbenzylaminoethyl)-γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, p-methylphenyltrimethoxysilane, methyltriethoxysilane, butyltriethoxysilane, hexyltriethoxysilane, octyltriethoxysilane, decyltriethoxysilane, dodecyltriethoxysilane, phenyltriethoxysilane, o-methylphenyltriethoxysilane, and p-methylphenyltriethoxysilane.

Further, the silica fine particles may be used after crushing of the silica fine particles in order to facilitate the monodispersion of the silica fine particles on the surfaces of the toner particles or to exhibit a stable spacer effect.

The silica fine particles A to be used in the present invention preferably have an apparent density of from 150 g/L to 300 g/L. The apparent density of the silica fine particles A falling within the above-mentioned range means that the silica fine particles A are hardly packed in a dense manner, are present while trapping a large amount of air between the fine particles, and have an extremely low apparent density. Accordingly, a mixing property between the toner particles and the silica fine particles A is easily improved in the external addition step, and hence a uniform coverage state of the toner is easily obtained. In addition, this phenomenon tends to be more significant, leading to a higher coverage ratio, when the average circularity or the aspect ratio of the toner particles is increased. As a result, the toner particles of the toner after external addition are hardly packed in a dense manner, and hence the inter-particle force is easily lowered.

As an approach to controlling the apparent density of the silica fine particles A to the above-mentioned range, there are given: hydrophobizing treatment in the silica sol suspension liquid, or adjustment of the intensity of the crushing after the hydrophobizing treatment; and the adjustment of a hydrophobizing treatment amount or the like. When uniform hydrophobizing treatment is performed, the amount of a relatively large aggregate itself can be reduced. Meanwhile, through the adjustment of the intensity of the crushing, a relatively large aggregate contained in the silica fine particles after drying can be loosened into relatively small secondary particles, and the apparent density can be lowered.

Herein, the silica fine particles A are added in an amount of preferably from 0.1 part by mass to 2.0 parts by mass of the silica fine particles A with respect to 100 parts by mass of the toner particles.

In the present invention, it is preferred that the inorganic fine particles further contain silica fine particles B and the silica fine particles B have a number average particle diameter (D1) of primary particles of from 5 nm to 20 nm. When the particle diameter falls within this range, imparting of flowability and a uniformly dispersed state on a toner surface are easily secured.

The silica fine particles B are fine particles generated by the vapor-phase oxidation of a silicon halide compound, and ones called dry process silica or fumed silica are preferably used. For example, such silica is produced by utilizing a thermal decomposition oxidation reaction in a silicon tetrachloride gas in oxygen and hydrogen, and a basic reaction formula for the reaction is as follows.

$$SiCl_4+2H_2+O_2 \rightarrow SiO_2+4HCl$$

In the production process, composite fine particles of silica and any other metal oxide may also be obtained by using a silicon halide compound with any other metal halide compound, such as aluminum chloride or titanium chloride, and the silica comprehends the composite fine particles as well.

In addition, the silica fine particles generated by the vapor-phase oxidation of the silicon halide compound are more preferably treated silica fine particles having surfaces subjected to hydrophobizing treatment. The silica fine particles subjected to the hydrophobizing treatment particularly each preferably have a hydrophobizing degree measured by a methanol titration test in the range of from 30 to 80.

As a method for the hydrophobizing treatment, there is given a method involving chemical treatment with an organic silicon compound and/or a silicone oil capable of reacting with, or being physically adsorbed by, the silica fine particles. As a preferred method, there is given a method involving chemically treating the silica fine particles generated by the vapor-phase oxidation of the silicon halide compound with an organic silicon compound.

Examples of the organic silicon compound include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, a triorganosilylmercaptan, trimethylsilylmercaptan, a triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing one hydroxyl group per Si in a siloxane unit positioned at the end. One kind of those compounds may be used alone, or two or more kinds thereof may be used as a mixture.

In addition, silane coupling agent each having a nitrogen atom, such as aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyldimethoxysilane, dibutylaminopropyldimethoxysilane, dibutylaminopropylmonomethoxysilane, dimethylaminophenyltriethoxysilane, trimethoxysilyl-γ-propylphenylamine, or trimethoxysilyl-γ-propylbenzylamine, may each be used alone, or may be used in combination. A preferred example of the silane coupling agent is hexamethyldisilazane (HMDS).

The silicone oil is preferably one having a viscosity at 25° C. of from 0.5 $mm^2/S$ to 10,000 $mm^2/S$, more preferably from 1 $mm^2/S$ to 1,000 $mm^2/S$, still more preferably from 10 $mm^2/S$ to 200 $mm^2/S$. Specific examples thereof include a dimethyl silicone oil, a methyl phenyl silicone oil, an α-methylstyrene-modified silicone oil, a chlorophenyl silicone oil, and a fluorine-modified silicone oil.

As a method for the silicone oil treatment, there is given, for example: a method involving directly mixing silane coupling agent-treated silica fine particles and the silicone oil through the use of a mixing machine, such as a Henschel mixer; a method involving spraying the silica fine particles serving as a base with the silicone oil; or a method involving dissolving or dispersing the silicone oil in an appropriate solvent, and then adding and mixing the silica fine particles, followed by the removal of the solvent.

The silica fine particles treated with the silicone oil more preferably have surface coats stabilized through heating of the silica in an inert gas at 200° C. or more (more preferably 250° C. or more) after the treatment with the silicone oil.

From the viewpoint of the ease of obtaining satisfactory hydrophobicity, the treatment amount of the silicone oil is preferably from 1 part by mass to 40 parts by mass, more preferably from 3 parts by mass to 35 parts by mass with respect to 100 parts by mass of the silica fine particles.

In order to impart satisfactory flowability to the toner, the silica fine particles before being subjected to the hydrophobizing treatment (base material silica) preferably have a specific surface area measured by a BET method based on nitrogen adsorption of from 200 $m^2/g$ to 350 $m^2/g$.

The specific surface area based on nitrogen adsorption measured by the BET method is measured in conformity to JIS 28830 (2001). As a measuring apparatus, there is used an "automatic specific surface area/pore distribution-measuring apparatus TriStar 3000 (manufactured by Shimadzu Corporation)," which employs a constant-volume gas adsorption method as a measurement system.

In the toner of the present invention, in addition to the silica fine particles, for example, any of the following may be used in a small amount to the extent that the effect of the present invention is not affected: lubricants, such as fluorine resin powder, zinc stearate powder, and polyvinylidene fluoride powder; abrasives, such as cerium oxide powder, silicon carbide powder, and strontium titanate powder; and spacer particles, such as silica.

A known mixing treatment apparatus, such as Henschel mixer, may be used as a mixing treatment apparatus for the external addition and mixing of the silica fine particles A and the silica fine particles B.

Figure 3:
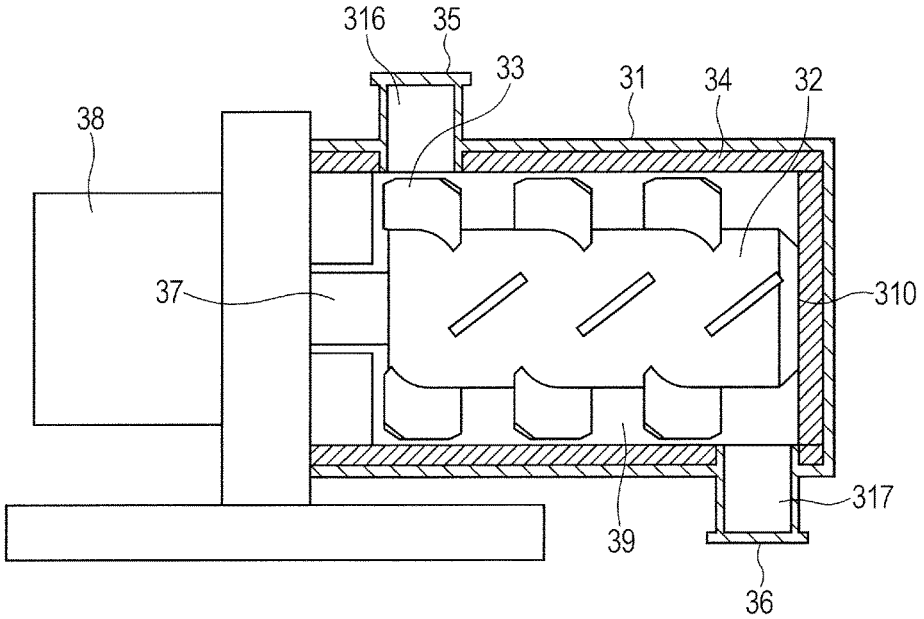
FIG. 3 is a schematic view for illustrating an example of the construction of stirring members to be used in a mixing treatment apparatus.

In addition, the silica fine particles B serving as an external additive having a small particle diameter as compared to the silica fine particles A are preferably externally added and mixed through the use of an apparatus as illustrated in FIG. 3 because the coverage ratio and the diffusion state of the external additive can be easily controlled.

In the present invention, a preferred external addition method is a two-stage external addition method involving first externally adding the silica fine particles A with a Henschel mixer as a first stage, and then externally adding the silica fine particles B by the construction illustrated in FIG. 3 as a second stage. In this case, the silica fine particles A serving as spacer particles can be externally added uniformly and with a high sticking ratio. Further, the silica fine particles B each having a small particle diameter can be externally added uniformly without promoting sticking, by the external addition treatment of the construction illustrated in FIG. 3. As a result, the inter-particle force of the present invention is easily controlled.

FIG. 3 is a schematic view for illustrating an example of a mixing treatment apparatus which may be used for externally adding and mixing the silica fine particles B to be used in the present invention.

The mixing treatment apparatus is configured to apply a shear to the toner particles and the silica fine particles B in a small clearance portion, and hence the silica fine particles B can be allowed to adhere to the surfaces of the toner particles while being loosened from secondary particles into primary particles.

Further, in the axial direction of a rotary member 32, the toner particles and the silica fine particles B easily circulate and are easily sufficiently uniformly mixed before their sticking proceeds. Consequently, the coverage ratio and the diffusion state are easily controlled and the toner-toner adhesion force (inter-particle force) is easily controlled to the range of the present invention.

Figure 6:
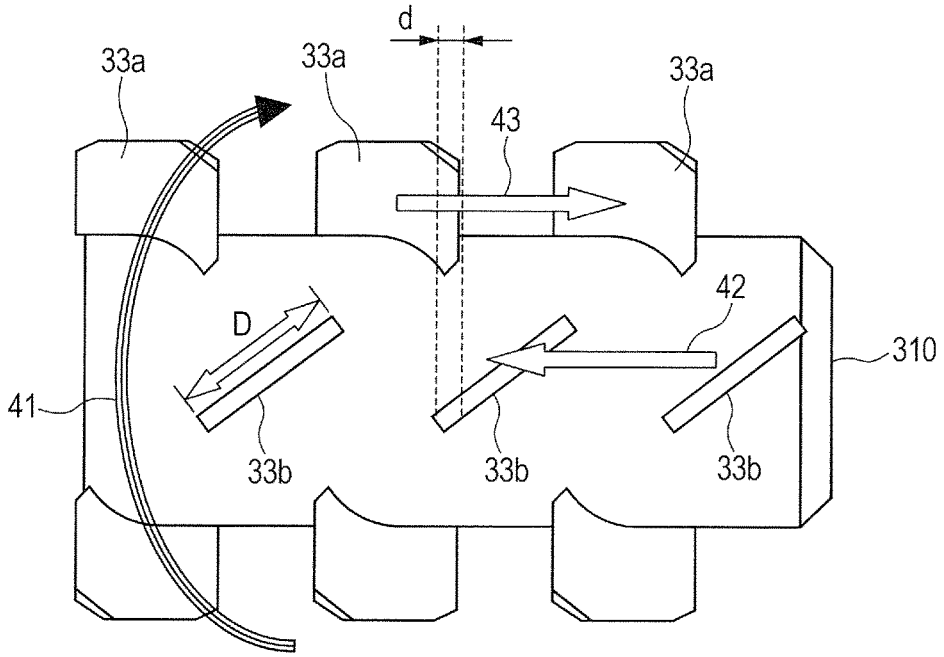
FIG. 6 is a schematic view for illustrating an example of the construction of the stirring members to be used in the mixing treatment apparatus.

Meanwhile, FIG. 6 is a schematic view for illustrating an example of the construction of stirring members to be used in the above-mentioned mixing treatment apparatus. Now, the external addition and mixing step of the silica fine particles B is described with reference to FIG. 3 and FIG. 6. The mixing treatment apparatus for externally adding and mixing the silica fine particles B includes at least: the rotary member 32 having a plurality of stirring members 33 arranged on a surface thereof; a driving member 38 configured to rotationally drive the rotary member; and a main body casing 31 arranged to have a gap between itself and each of the stirring members 33. The mixing treatment apparatus further includes a jacket 34 through which a heat transfer medium is allowed to flow and which is arranged on the inside of the main body casing 31 and at an end portion side surface 310 of the rotary member. The mixing treatment apparatus further includes a raw material feed port 35 formed at the top of the main body casing 31, for introducing the toner particles and the silica fine particles B, and a product discharge port 36 formed at the bottom of the main body casing 31, for discharging a toner subjected to external addition and mixing treatment out of the main body casing 31. Further, a raw material feed port inner piece 316 is inserted into the raw material feed port 35, and a product discharge port inner piece 317 is inserted into the product discharge port 36.

In order to uniformly apply a shear to the toner particles and thereby facilitate the adhesion of the silica fine particles B onto the surfaces of the toner particles while loosening their secondary particles into primary particles, it is important for the gap (clearance) between the inner periphery of the main body casing 31 and each of the stirring members 33 to be kept constant and very small.

In addition, in this apparatus, the diameter of the inner periphery of the main body casing 31 is 2 or less times as large as the diameter of the outer periphery of the rotary member 32. FIG. 3 is an illustration of an example in which the diameter of the inner periphery of the main body casing 31 is 1.7 times as large as the diameter of the outer periphery of the rotary member 32 (the diameter of the body of the rotary member 32 excluding the stirring members 33). When the diameter of the inner periphery of the main body casing 31 is 2 or less times as large as the diameter of the outer periphery of the rotary member 32, a treatment space in which a force acts on the toner particles is appropriately restricted, and hence a sufficient impact force is applied to the silica fine particles B which are present as secondary particles. In addition, it is important to adjust the clearance depending on the size of the main body casing. Setting of the clearance to the range of from about 1% to 5% of the diameter of the inner periphery of the main body casing 31 is important for applying a sufficient shear to the silica fine particles B. Specifically, when the diameter of the inner periphery of the main body casing 31 is about 130 mm, it is appropriate to set the clearance to the range of from about 2 mm to about 5 mm, and when the diameter of the inner periphery of the main body casing 31 is about 800 mm, it is appropriate to set the clearance to the range of from about 10 mm to about 30 mm.

In the external addition and mixing step of the silica fine particles B in the present invention, the surfaces of the toner particles are subjected to external addition and mixing treatment with the silica fine particles B using the mixing treatment apparatus by rotating the rotary member 32 by the driving member 38 and stirring and mixing the toner particles and the silica fine particles B fed into the mixing treatment apparatus. As illustrated in FIG. 6, at least some of the plurality of stirring members 33 are formed as forward stirring members 33*a* configured to transport the toner particles and the silica fine particles B forward in one direction of the axial direction of the rotary member 32 along with the rotation of the rotary member 32. In addition, at least some of the plurality of stirring members 33 are formed as backward stirring members 33*b* configured to transport the toner particles and the silica fine particles B backward in the other direction of the axial direction of the rotary member 32 along with the rotation of the rotary member 32. In this case, as illustrated in FIG. 3, when the raw material feed port 35 and the product discharge port 36 are arranged at both end portions of the main body casing 31, the direction toward the product discharge port 36 from the raw material feed port 35 (direction to the right in FIG. 3) is referred to as "forward direction".

That is, as illustrated in FIG. 6, the plate surfaces of the forward stirring members 33*a* are tilted so as to transport the toner particles in a forward direction (43). Meanwhile, the plate surfaces of the stirring members 33*b* are tilted so as to transport the toner particles and the silica fine particles B in a backward direction (42). In this manner, while transport in the "forward direction" (43) and transport in the "backward direction" (42) are repeatedly performed, the surfaces of the toner particles are subjected to external addition and mixing treatment with the silica fine particles B. In addition, the stirring members 33*a* and 33*b* form sets each including a plurality of members arranged at an interval in the circumferential direction of the rotary member 32. In the example illustrated in FIG. 6, the stirring members 33*a* and 33*b* form sets each including two members at a mutual interval of 180 degrees on the rotary member 32. However, a large number of members may form a set, such as three members at an interval of 120 degrees or four members at an interval of 90 degrees. In the example illustrated in FIG. 6, a total of twelve stirring members 33*a* and 33*b* are formed at an equal interval.

Further, in FIG. 6, the width of the stirring member is represented by "D" and a distance which represents an overlapping portion of the stirring members is represented by d. From the viewpoint of efficiently transporting the toner particles and the silica fine particles B in the forward direction and the backward direction, the width "D" is preferably from about 20% to about 30% with respect to the length of the rotary member 32 in FIG. 6. In FIG. 6, an example of 23% is illustrated. Further, the stirring members 33*a* and 33*b* preferably have some degree of an overlapping portion "d" of stirring members with the stirring members 33*a* and 33*b* when a line is extended from an end portion position of the stirring members 33*a* and 33*b* in a vertical direction. With this, a shear can be efficiently applied to the silica fine particles B which are present as secondary particles. A ratio of "d" to "D" of from 10% to 30% is preferred for applying a shear.

It should be noted that other than the shape as illustrated in FIG. 6, the following blade shape may be adopted as long as the toner particles can be transported in the forward direction and the backward direction and the clearance can be maintained: a shape having a curved surface or a paddle structure in which an end blade portion is connected to the rotary member 32 by a rod-shaped arm.

In the present invention, first, the raw material feed port inner piece 316 is removed from the raw material feed port 35, and the toner particles are fed into a treatment space 39 from the raw material feed port 35. Next, the silica fine particles are fed into the treatment space 39 from the raw material feed port 35, and the raw material feed port inner piece 316 is inserted. Next, the rotary member 32 is rotated (in a rotation direction 41) by the driving member 38. Thus, the treatment materials fed as described above are subjected to external addition and mixing treatment while being stirred and mixed by the plurality of stirring members 33 arranged on the surface of the rotary member 32. It should be noted that the following order of feeding may be adopted: first, the silica fine particles are fed from the raw material feed port 35, and then the toner particles are fed from the raw material feed port 35. In addition, the toner particles and the silica fine particles B may be mixed in advance with a mixing machine, such as a Henschel mixer, before being fed as a mixture from the raw material feed port 35 of the apparatus illustrated in FIG. 3.

As a condition for the external addition and mixing treatment, the power of the driving member 38 is preferably controlled to the range of from 0.2 W/g to 2.0 W/g in order to improve the coverage ratio and the diffusion property. In addition, the power of the driving member 38 is more preferably controlled to the range of from 0.6 W/g to 1.6 W/g. A treatment time is not particularly limited, but is preferably from 3 minutes to 10 minutes.

Further, in the present invention, a particularly preferred treatment method involves a premixing step for each of the silica fine particles B before the operation of the external addition and mixing treatment. When the premixing step is present, the silica fine particles B are uniformly dispersed to a high degree on the surfaces of the toner particles to facilitate the control of the inter-particle force. More specifically, as premixing treatment conditions, it is preferred to set the power of the driving member 38 to the range of from 0.06 W/g to 0.20 W/g and set a treatment time to the range of from 0.5 minute to 1.5 minutes. With regard to the number of rotations of a stirring member in the premixing treatment, in an apparatus in which the treatment space 39 of the apparatus illustrated in FIG. 3 has a volume of $2.0\times10^{-3}$ $m^3$, the number of rotations of the stirring member when each of the stirring members 33 has the shape illustrated in FIG. 6 is preferably from 50 rpm to 500 rpm. After the completion of the external addition and mixing treatment, the product discharge port inner piece 317 in the product discharge port 36 is removed, and the toner is discharged from the product discharge port 36 by rotating the rotary member 32 by the driving member 38. As required, coarse particles and the like are separated from the resultant toner with a sieve, such as a circular oscillating sieve, to provide a finished toner.

In addition, the toner particles to be used in the present invention have an aspect ratio of preferably 0.900 or more, more preferably 0.920 or more in order to prevent the migration of the external additive stuck to the surfaces of the particles into recessed portions through long-term use, enable uniform sticking in the external addition step, and impart a uniform charge in the regulating portion.

Now, a production method for the toner of the present invention is exemplified, but is not limited to the following.

The toner particles to be contained in the toner of the present invention may be produced by a pulverization method, but the toner particles to be obtained are generally amorphous and an external additive on the toner particles may roll into recessed portions through long-term use. Accordingly, in order to obtain the effect of the present invention, it is preferred to perform mechanical/thermal treatment or some special treatment to suppress the rolling into the recessed portions.

In view of the foregoing, the toner of the present invention is preferably produced by a technique of sphering toner particles produced by the pulverization method through heat sphering treatment or a technique of producing a toner by a dispersion polymerization method, an emulsion aggregation method, a dissolution suspension method, a suspension polymerization method, or the like. In particular, the suspension polymerization method is extremely preferred because the suspension polymerization method allows easy control of the aspect ratio, hardly causes the rolling of the external additive into the recessed portions of the toner particles, and easily provides a toner satisfying suitable physical properties of the present invention.

The suspension polymerization method is as described below. A polymerizable monomer and a colorant (and as required, a polymerization initiator, a crosslinking agent, a charge control agent, and other additives) are uniformly dispersed to provide a polymerizable monomer composition. After that, the resultant polymerizable monomer composition is dispersed in a continuous layer (such as an aqueous phase) containing a dispersion stabilizer using an appropriate stirrer and a polymerization reaction is performed using the polymerization initiator to generate a binder resin, to thereby provide toner particles each having a desired particle diameter. In the toner obtained by the suspension polymerization method (hereinafter sometimes referred to as "polymerized toner"), the shapes of individual toner particles are substantially uniformly spherical, and hence a toner satisfying a physical property requirement suitable for the present invention, i.e., an average circularity of 0.960 or more is easily obtained.

Examples of the polymerizable monomer include the monomers for generating the styrene-based resin described above.

The polymerization initiator to be used in the suspension polymerization method is preferably one having a half-life of from 0.5 hour to 30 hours in a polymerization reaction. In addition, the polymerization initiator is added in an amount of preferably from 0.5 part by mass to 20 parts by mass with respect to 100 parts by mass of the polymerizable monomer.

Specific examples of the polymerization initiator include: azo-based or diazo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide-based polymerization initiators such as benzoyl peroxide, methyl ethyl ketone peroxide, diisopropyl peroxydicarbonate, cumene hydroperoxide, 2,4-dichlorobenzoyl peroxide, lauroyl peroxide, t-butyl peroxy-2-ethylhexanoate, t-butyl peroxypivalate, di(2-ethylhexyl) peroxydicarbonate, and di(sec-butyl) peroxydicarbonate. Of those, di(2-ethylhexyl) peroxydicarbonate and di(sec-butyl) peroxydicarbonate which are of a peroxydicarbonate type are preferably used because, as described above, a binder resin which has a low molecular weight and has a linear-type molecular structure is easily produced.

In the suspension polymerization method, a crosslinking agent may be added in a polymerization reaction. The crosslinking agent is added in an amount of preferably from 0.001 part by mass to 15 parts by mass with respect to 100 parts by mass of the polymerizable monomer. Examples of the crosslinking agent include the crosslinking agents which may be used for obtaining the vinyl-based resin described above.

The polymerizable monomer composition preferably contains a polar resin. In the suspension polymerization method, the toner particles are produced in an aqueous medium, and hence when the polar resin is contained, the polar resin is allowed to be present in the vicinity of the surface of each of the toner particles.

The presence of the polar resin in the vicinity of the surface provides an advantage in, for example, that endurance deterioration, such as the embedment of the silica fine particles, can be suppressed by increasing the glass transition temperature of the polar resin.

Examples of the polar resin include: homopolymers of styrene and substituted products thereof, such as polystyrene and polyvinyltoluene; styrene-based copolymers, such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-maleic acid copolymer, and a styrene-maleate copolymer; and polymethyl methacrylate, polybutyl methacrylate, polyvinyl acetate, polyethylene, polypropylene, polyvinyl butyral, a silicone resin, a polyester resin, a styrene-polyester copolymer, a polyacrylate-polyester copolymer, a polymethacrylate-polyester copolymer, a polyamide resin, an epoxy resin, a polyacrylic acid resin, a terpene resin, and a phenol resin. Those polar resins may each be used alone, or two or more kinds thereof may be used as a mixture. In addition, a functional group, such as an amino group, a carboxyl group, a hydroxyl group, a sulfonic acid group, a glycidyl group, or a nitrile group, may be introduced into any such polymer. Of those resins, a polyester resin is preferred.

As the polyester resin, the polyester resin described above may be used.

The polar resin preferably has an acid value of from 0.5 mgKOH/g to 10 mgKOH/g. When the acid value is 0.5 mgKOH/g or more, a uniform shell is easily formed. In addition, in the case where the magnetic fine particles are used as the colorant of the toner particles, when the acid value of the polar resin is 10 mgKOH/g or less, an interaction with the magnetic fine particles is small, which facilitates the suppression of the aggregating property of the magnetic fine particles. Accordingly, the magnetic fine particles in the toner particles are uniformly dispersed to facilitate the improvement of the uniform chargeability of the toner.

From the viewpoint of sufficiently obtaining an effect which allows the control of the embedment of the external additive, the polar resin is preferably contained at from 2 parts by mass to 10 parts by mass with respect to 100 parts by mass of the binder resin.

The aqueous medium in which the polymerizable monomer composition is dispersed contains a dispersion stabilizer. A known surfactant or a known organic dispersant or inorganic dispersant may be used as the dispersion stabilizer. Of those, an inorganic dispersant may be preferably used because the stability of the inorganic dispersant is hardly impaired even when a reaction temperature is changed, by virtue of its dispersion stability based on a steric hindrance property, and because the inorganic dispersant can be easily washed and has little adverse effect on the toner. Examples of such inorganic dispersant include: polyvalent metal phosphates, such as tricalcium phosphate, magnesium phosphate, aluminum phosphate, zinc phosphate, and hydroxyapatite; carbonates, such as calcium carbonate and magnesium carbonate; inorganic salts, such as calcium metasilicate, calcium sulfate, and barium sulfate; and inorganic compounds, such as calcium hydroxide, magnesium hydroxide, and aluminum hydroxide.

Such inorganic dispersant is preferably used in an amount of 0.2 part by mass or more and 20 parts by mass or less with respect to 100 parts by mass of the polymerizable monomer. In addition, one kind of the dispersion stabilizers may be used alone, or a plurality of kinds thereof may be used in combination. Further, a surfactant may be used in combination in an amount of 0.001 part by mass or more and 0.1 part by mass or less.

Examples of the surfactant include sodium dodecylbenzene sulfate, sodium tetradecyl sulfate, sodium pentadecyl sulfate, sodium octyl sulfate, sodium oleate, sodium laurate, sodium stearate, and potassium stearate.

In the step of polymerizing the polymerizable monomer, the polymerization temperature is set to 40° C. or more, generally 50° C. or more and 90° C. or less.

After the completion of the polymerization of the polymerizable monomer, the resultant polymer particles are filtered, washed, and dried by known methods. Thus, toner particles are obtained. The toner of the present invention can be obtained by externally adding and mixing inorganic fine particles (silica fine particles) into the toner particles so that the inorganic fine particles are allowed to adhere to the surfaces of the toner particles. In addition, coarse powder and fine powder in the toner particles can be removed by incorporating a classifying step in the production steps (before the mixing of the inorganic fine particles).

Figure 1B:
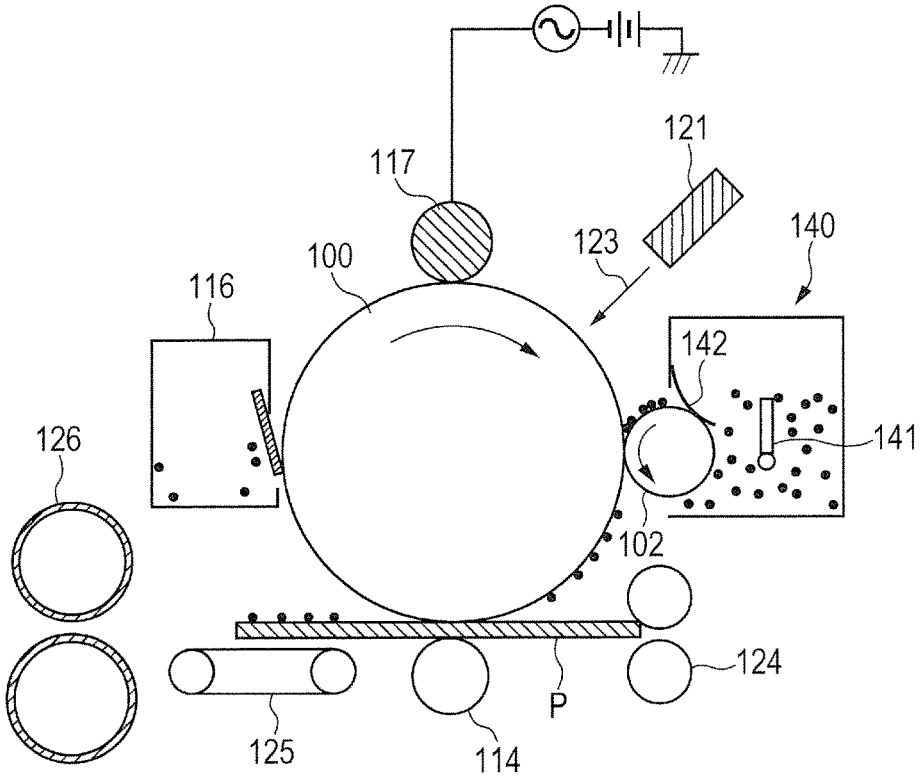
FIG. 1B is an illustration of an example of the image-forming apparatus.

Next, an example of an image-forming apparatus in which the toner of the present invention may be suitably used is specifically described with reference to FIG. 1A and FIG. 1B. In FIG. 1A and FIG. 1B, around an electrostatic latent image-bearing member 100, there are arranged a charging member (charging roller) 117, a developing device 140 including a toner carrier 102, a transfer member (transfer charging roller) 114, a waste toner container 116, a fixing device 126, a pickup roller 124, a conveyance belt 125, and the like. The electrostatic latent image-bearing member 100 is charged by the charging roller 117. Then, the electrostatic latent image-bearing member 100 is exposed by being irradiated with laser light 123 by means of a laser-generating apparatus 121. Thus, an electrostatic latent image corresponding to an image of interest is formed. The electrostatic latent image on the electrostatic latent image-bearing member 100 is developed with a toner by the developing device 140 to provide a toner image, and the toner image is transferred onto a transfer material P by the transfer charging roller 114, which is brought into abutment with the electrostatic latent image-bearing member through the intermediation of the transfer material P. The transfer material P having the toner image thereon is carried to the fixing device 126, and the toner image is fixed onto the transfer material. In addition, part of the toner remaining on the electrostatic latent image-bearing member is scraped off with a cleaning blade and stored in the waste toner container 116.

Next, measurement methods for physical properties according to the toner of the present invention are as described below. Examples to be described later are also based on these methods.

<Measurement Method for Number Average Particle Diameter (D1) of Silica Fine Particles A>

The number average particle diameter of the silica fine particles A is determined by observing the silica fine particles A stuck onto the toner with a scanning electron microscope. A Hitachi ultrahigh resolution field-emission scanning electron microscope S-4800 (manufactured by Hitachi High-Technologies Corporation) is used as the scanning electron microscope. The imaging conditions of 5-4800 are as described below.

(1) Sample Preparation

A conductive paste is thinly spread over a sample stage (aluminum sample stage measuring 15 mm×6 mm), and the toner is sprayed. Further, air is blown to remove an excess toner from the sample stage and to sufficiently dry the paste. The sample stage is set in a sample holder and the height of the sample stage is adjusted to 36 mm with a sample height gauge.

(2) Setting of S-4800 Observation Conditions

The number average particle diameter of the primary particles of the silica fine particles is calculated using an image obtained by backscattered electron image observation with S-4800. Less charge-up of the silica fine particles occurs in a backscattered electron image as compared to a secondary electron image, and hence the particle diameters of the silica fine particles can be precisely measured.

Liquid nitrogen is injected to the point of overflowing into an anti-contamination trap mounted on the mirror body of S-4800, and the whole is left to stand for 30 minutes. "PCSTEM" for S-4800 is booted up, and flushing (cleaning of an FE chip serving as an electron source) is performed. The acceleration voltage indicator of the control panel on the screen is clicked, the [Flushing] button is pressed, and the Flushing Execution dialog is opened. Flushing is executed after the confirmation that the flushing strength is 2. It is confirmed that the emission current due to the flushing is from 20 μA to 40 μA. The sample holder is inserted into the sample chamber on the mirror body of S-4800. [Home] in the control panel is pressed to move the sample holder to the observation position.

The acceleration voltage indicator is clicked and the HV selection dialog is opened. The acceleration voltage is set to [0.8 kV] and the emission current is set to [20 μA]. Within the [Basic] tab in the operation panel, the signal selection is set to [SE], [Up (U)] and [+BSE] are selected as SE detectors, [L.A.100] is selected in the selection box to the right of [+BSE], to thereby establish the mode for observation in a backscattered electron image.

Also within the [Basic] tab in the operation panel, the probe current in the Electron Optics Conditions block is set to [Normal], the focus mode is set to [UHR], and WD is set to [3.0 mm]. The [ON] button of the acceleration voltage indicator in the control panel is pressed to apply the acceleration voltage.

(3) Calculation of Number Average Particle Diameter (D1) of Silica Fine Particles ("da" to be Used in Calculation of Theoretical Coverage Ratio)

The magnification indicator in the control panel is dragged and the magnification is set to 100,000× (100 k). The focus knob [COARSE] in the operation panel is rotated, and when the image is in focus to some degree, the aperture alignment is adjusted. [Align] in the control panel is clicked to display the alignment dialog, and [Beam] is selected. The STIGMA/ALIGNMENT knobs (X, Y) in the operation panel are rotated to move the displayed beam to the center of the concentric circle.

Next, [Aperture] is selected, and the STIGMA/ALIGNMENT knobs (X, Y) are turned one at a time for adjustment so as to stop or minimize image movement. The aperture dialog is closed and the focus is adjusted by autofocus. This operation is repeated two more times to adjust the focus.

After that, particle diameters are measured for at least 300 silica fine particles on the surfaces of the toner particles, and their average particle diameter is determined. Herein, some of the silica fine particles A are present as an aggregate mass depending on the external addition method, and hence the number average particle diameter (D1) of the primary particles of the silica fine particles is obtained by determining the maximum diameters of particles which can be confirmed to be primary particles, and calculating the arithmetic average of the maximum diameters thus obtained.

<Measurement Method for Weight Average Particle Diameter (D4)>

The weight average particle diameter (D4) of the toner was calculated through measurement at a number of effective measurement channels of 25,000, followed by the analysis of measurement data, by using a precision particle size distribution measuring apparatus based on a pore electrical resistance method provided with a 100-μm aperture tube "Coulter Counter Multisizer 3" (trademark, manufactured by Beckman Coulter, Inc.) and dedicated software included therewith "Beckman Coulter Multisizer 3 Version 3.51" (manufactured by Beckman Coulter, Inc.) for setting measurement conditions and analyzing measurement data.

An electrolyte aqueous solution prepared by dissolving reagent grade sodium chloride in ion-exchanged water to have a concentration of about 1 mass %, for example, "ISOTON II" (manufactured by Beckman Coulter, Inc.) may be used in the measurement.

It should be noted that the dedicated software was set as described below prior to the measurement and the analysis.

In the "Standard Measurement Method (SOM)" Change Screen" of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value. A threshold and a noise level are automatically set by pressing a threshold/noise level measurement button. In addition, a current is set to 1,600 μA, a gain is set to 2, and an electrolyte solution is set to ISOTON II, and a check mark is placed in a check box as to whether the aperture tube is flushed after the measurement.

In the "Pulse-to-particle Diameter Conversion Setting Screen" of the dedicated software, a bin interval is set to a logarithmic particle diameter, the number of particle diameter bins is set to 256, and a particle diameter range is set to the range of from 2 μm to 60 μm.

A specific measurement method is as described below.

(1) About 200 ml of the electrolyte aqueous solution is charged into a 250-ml round-bottom glass beaker dedicated for Multisizer 3. The beaker is set in a sample stand, and the electrolyte aqueous solution in the beaker is stirred with a stirrer rod at 24 rotations/sec in a counterclockwise direction. Then, dirt and bubbles in the aperture tube are removed by the "Aperture Flushing" function of the analysis software.

(2) About 30 ml of the electrolyte aqueous solution is charged into a 100-ml flat-bottom glass beaker. About 0.3 ml of a diluted solution prepared by diluting "Contaminon N" (a 10 mass % aqueous solution of a neutral detergent for washing a precision measuring device containing a nonionic surfactant, an anionic surfactant, and an organic builder and having a pH of 7, manufactured by Wako Pure Chemical Industries, Ltd.) with ion-exchanged water by three mass fold is added as a dispersant to the electrolyte aqueous solution.

(3) A predetermined amount of ion-exchanged water is charged into the water tank of an ultrasonic dispersing unit "Ultrasonic Dispension System Tetora 150" (manufactured by Nikkaki Bios Co., Ltd.) in which two oscillators each having an oscillatory frequency of 50 kHz are built so as to be out of phase by 180° and which has an electrical output of 120 W. About 2 ml of the Contaminon N is added into the water tank.

(4) The beaker in the section (2) is set in the beaker fixing hole of the ultrasonic dispersing unit, and the ultrasonic dispersing unit is operated. Then, the height position of the beaker is adjusted so that the liquid level of the electrolyte aqueous solution in the beaker resonates to the fullest extent possible.

(5) About 10 mg of toner is gradually added to and dispersed in the electrolyte aqueous solution in the beaker in the section (4) under a state in which the electrolyte aqueous solution is irradiated with an ultrasonic wave. Then, the ultrasonic dispersion treatment is continued for an additional 60 seconds. It should be noted that the temperature of water in the water tank is appropriately adjusted to the range of from 10° C. to 40° C. upon ultrasonic dispersion.

(6) The electrolyte aqueous solution in the section (5) in which the toner has been dispersed is dropped with a pipette to the round-bottom beaker in the section (1) placed in the sample stand, and the concentration of the toner to be measured is adjusted to about 5%. Then, measurement is performed until the particle diameters of 50,000 particles are measured.

(7) The measurement data is analyzed with the dedicated software included with the apparatus, and the weight average particle diameter (D4) is calculated. It should be noted that the "Arithmetic Diameter" on the analysis/volume statistics (arithmetic average) screen of the dedicated software when the dedicated software is set to show a graph in a vol % unit is the weight average particle diameter (D4).

<Measurement Method for Half Width of Maximum Peak in Weight-Based Particle Size Distribution of Silica Fine Particles A>

The half width in the weight-based particle size distribution of the silica fine particles A is measured using a disc centrifugal particle size distribution-measuring apparatus DC24000 manufactured by CPS Instruments Inc. A measurement method is described below.

1) In the Case of Magnetic Toner

First, 0.5 mg of Triton-X100 (manufactured by Kishida Chemical Co., Ltd.) is added into 100 g of ion-exchanged water to prepare a dispersion medium. 1 g of the toner is added to 9 g of the dispersion medium, and dispersed for 5 minutes with an ultrasonic disperser. After that, a neodymium magnet is used to bind the toner particles to prepare a supernatant. Next, a measuring apparatus-dedicated syringe needle manufactured by CPS Instruments Inc. is attached to the tip of All-Plastic Disposable Syringe (manufactured by TGK) having attached thereto a syringe filter (diameter: 13 mm/pore diameter: 0.45 μm) (manufactured by Advantec Toyo Kaisha, Ltd.), and 0.1 mL of the supernatant is collected. The supernatant collected with the syringe is injected into the disc centrifugal particle size distribution-measuring apparatus DC24000, and subjected to the measurement of the half width in the weight-based particle size distribution of the silica fine particles A.

Details of the measurement method are as described below.

First, a disc of the apparatus is rotated at 24,000 rpm with Motor Control in CPS software. After that, the following conditions are set in Procedure Definitions.

(1) Sample Parameter

Maximum Diameter: 0.5 μm

Minimum Diameter: 0.05 μm

Particle Density: 2.0 g/mL to 2.2 g/mL (appropriately adjusted depending on a sample)

Particle Refractive Index: 1.43

Particle Absorption: 0 K

Non-Sphericity Factor: 1.1

(2) Calibration Standard Parameters

Peak Diameter: 0.226 μm

Half Height Peak Width: 0.1 μm

Particle Density: 1.389 g/mL

Fluid Density: 1.059 g/mL

Fluid Refractive Index: 1.369

Fluid Viscosity: 1.1 cps

After the above-mentioned conditions have been set, an automated gradient maker AG300 manufactured by CPS Instruments Inc. is used to prepare a density gradient solution formed of a 8 mass % sucrose aqueous solution and a 24 mass % sucrose aqueous solution, and 15 mL of the density gradient solution is injected into a measurement container.

After the injection, in order to prevent the evaporation of the density gradient solution, 1.0 mL of dodecane (manufactured by Kishida Chemical Co., Ltd.) is injected to form an oil film, followed by a wait of 30 minutes or more for stabilizing the apparatus.

Figure 4:
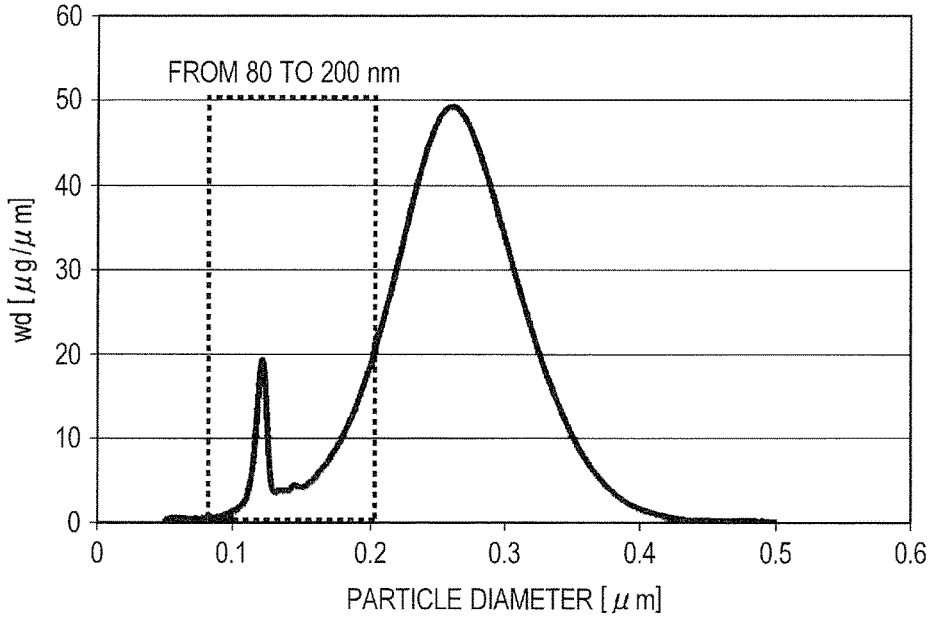
FIG. 4 is an example of measurement data on a half width in the weight-based particle size distribution of silica fine particles B.

After the wait, standard particles for calibration (weight-based median particle diameter: 0.226 μm) are injected with a 0.1-mL syringe into the measuring apparatus, and calibration is performed. After that, the supernatant collected in the foregoing is injected into the apparatus, and subjected to the measurement of a half width in a weight-based particle size distribution. An example of data obtained in actual measurement is shown in FIG. 4. The half width of a peak obtained in the range of from 80 nm to 200 nm in the weight-based particle size distribution as shown in FIG. 4 is defined as the value of the half width in the weight-based particle size distribution of the silica fine particles A.

2) In the Case of Non-Magnetic Toner

First, 0.5 mg of Triton-X100 (manufactured by Kishida Chemical Co., Ltd.) is added into 100 g of ion-exchanged water to prepare a dispersion medium. 0.6 g of the toner is added to 9.4 g of the dispersion medium, and dispersed for 5 minutes with an ultrasonic disperser. After that, a measuring apparatus-dedicated syringe needle manufactured by CPS Instruments Inc. is attached to the tip of All-Plastic Disposable Syringe (manufactured by TGK) having attached thereto a syringe filter (diameter: 13 mm/pore diameter: 0.45 μm) (manufactured by Advantec Toyo Kaisha, Ltd.), and 0.1 mL of a supernatant is collected. The supernatant collected with the syringe is injected into the disc centrifugal particle size distribution-measuring apparatus DC24000, and subjected to the measurement of the half width in the weight-based particle size distribution of the silica fine particles A. Details of the measurement method are as described above.

<Measurement Method for Average Circularity and Aspect Ratio of Toner Particles>

The average circularity of toner particles and the aspect ratio of toner particles are measured under measurement and analysis conditions at the time of a calibration operation with a flow-type particle image analyzer "FPIA-3000" (manufactured by Sysmex Corporation).

A specific measurement method is as described below. First, about 20 ml of ion-exchanged water from which an impure solid and the like have been removed in advance is charged into a glass vessel. About 0.2 ml of a diluted solution prepared by diluting "Contaminon N" (a 10 mass % aqueous solution of a neutral detergent for washing a precision measuring unit containing a nonionic surfactant, an anionic surfactant, and an organic builder and having a pH of 7, manufactured by Wako Pure Chemical Industries, Ltd.) with ion-exchanged water by about three mass fold is added as a dispersant to the vessel. Further, about 0.02 g of a measurement sample is added to the vessel, and then the mixture is subjected to dispersion treatment with an ultrasonic dispersing unit for 2 minutes so that a dispersion liquid for measurement may be obtained. At that time, the dispersion liquid is appropriately cooled so as to have a temperature of from 10° C. to 40° C. A desktop ultrasonic cleaning and dispersing unit having an oscillatory frequency of 50 kHz and an electrical output of 150 W (such as "VS-150" (manufactured by VELVO-CLEAR)) is used as the ultrasonic dispersing unit. A predetermined amount of ion-exchanged water is charged into a water tank, and about 2 ml of the Contaminon N is added to the water tank.

The flow-type particle image analyzer provided with "LUCPLFLN" (magnification: 20, numerical aperture: 0.40) as an objective lens was used in the measurement, and a particle sheath "PSE-900A" (manufactured by Sysmex Corporation) was used as a sheath liquid. The dispersion liquid prepared in accordance with the procedure is introduced into the flow-type particle image analyzer, and 2,000 toner particles are subjected to measurement according to the total count mode of an HPF measurement mode. Then, the average circularity and the aspect ratio of the toner particles are determined with a binarization threshold at the time of particle analysis set to 85% and particle diameters to be analyzed limited to ones each corresponding to a circle-equivalent diameter of 1.977 μm or more and less than 39.54 μm.

In the measurement, automatic focusing is performed with standard latex particles (obtained by diluting, for example, "RESEARCH AND TEST PARTICLES Latex Microsphere Suspensions 5100A" manufactured by Duke Scientific with ion-exchanged water) prior to the initiation of the measurement. After that, focusing is preferably performed every two hours from the initiation of the measurement.

It should be noted that in Examples of the present application, a flow-type particle image analyzer which has been subjected to a calibration operation by Sysmex Corporation and has received a calibration certificate issued by Sysmex Corporation is used. The measurement is performed under measurement and analysis conditions identical to those at the time of the reception of the calibration certificate except that particle diameters to be analyzed are limited to ones each corresponding to a circle-equivalent diameter of 1.977 μm or more and less than 39.54 μm.

<Measurement Method for Silica Coverage Ratio of Toner>

The silica coverage ratio of the toner in the present invention is calculated based on the amount of silicon (hereinafter abbreviated as "Si") atoms derived from silica present on the surface of each of the toner particles measured by X-ray photoelectron spectroscopy (ESCA).

An apparatus and measurement conditions for ESCA are as described below.

Apparatus Used: Quantum 2000 manufactured by ULVAC-PHI, Inc.

Analysis Method: narrow analysis

Measurement Conditions:

X-ray Source: Al-Kα

X-ray Condition: 100 μm, 25 W, 15 kV

Photoelectron Acceptance Angle: 45°

Pass Energy: 58.70 eV

Measurement Range: ϕ100 μm

The measurement was carried out under the above-mentioned conditions.

An analysis method is as described below. First, a peak derived from a C—C bond of carbon is orbitals is corrected to 285 eV. After that, based on a peak area derived from a silicon 2p orbital having a peak top detected in the range of from 100 eV to 105 eV, the amount of Si derived from silica with respect to the total amount of constituent elements is calculated using a relative sensitivity factor provided by ULVAC-PHI, Inc.

Next, silica applied to the toner is alone subjected to measurement by the same method as that described above, and the amount of Si derived from the silica with respect to the total amount of constituent elements is calculated. The ratio of the Si amount when the toner is subjected to measurement to the Si amount when the external additive alone is subjected to measurement is defined as the silica coverage ratio in the present invention.

In addition, in the case of using, as a measurement sample, silica fine particles separated from the surfaces of the toner particles, the silica fine particles are separated from the toner particles by the following procedure.

1) In the Case of Magnetic Toner

First, 6 mL of Contaminon N (a 10 mass % aqueous solution of a neutral detergent for washing a precision measuring device containing a nonionic surfactant, an anionic surfactant, and an organic builder and having a pH of 7, manufactured by Wako Pure Chemical Industries, Ltd.) is added into 100 mL of ion-exchanged water to prepare a dispersion medium. 5 g of the toner is added to the dispersion medium, and dispersed for 5 minutes with an ultrasonic disperser. After that, the resultant is set in "KM Shaker" (model: V.SX) manufactured by Iwaki Sangyo, and shaken for 20 minutes under the condition of 350 reciprocations per minute.

After that, a neodymium magnet is used to attract the toner particles and a supernatant is collected. The supernatant is dried to collect the silica fine particles. When a sufficient amount of the silica fine particles cannot be collected, this operation is repeatedly performed.

In this method, when an external additive other than the silica fine particles is added, the external additive other than the silica fine particles is also collected. In such case, it is appropriate to sort the silica fine particles from the collected external additives through the utilization of a centrifugation method or the like.

2) In the Case of Non-Magnetic Toner 160 g of sucrose (manufactured by Kishida Chemical Co., Ltd.) is added to 100 mL of ion-exchanged water, and dissolved therein in a hot water bath to prepare a sucrose syrup. 31 g of the sucrose syrup and 6 mL of Contaminon N are charged into a centrifuge tube to prepare a dispersion liquid. 1 g of the toner is added to the dispersion liquid, and lumps of the toner are loosened with a spatula or the like.

The centrifuge tube is shaken for 20 minutes under the condition of 350 reciprocations per minute with the above-mentioned shaker. After the shaking, the solution is transferred to a glass tube (50 mL) for Swing Rotor and centrifuged with the centrifuge under the conditions of 3,500 rpm and 30 minutes. In the glass tube after the centrifugation, the toner is present in the uppermost layer, and the silica fine particles are present on the aqueous solution side serving as the lower layer. The aqueous solution serving as the lower layer is collected and centrifuged to separate the sucrose and the silica fine particles, and the silica fine particles are collected. As required, the centrifugation is repeated, and after sufficient separation, the dispersion liquid is dried and the silica fine particles are collected.

As in the case of the magnetic toner, when an external additive other than the silica fine particles is added, the external additive other than the silica fine particles is also collected. Accordingly, the silica fine particles are sorted from the collected external additives through the utilization of a centrifugation method or the like.

<Measurement Method for Inter-Particle Force>

The inter-particle force of the toner is measured using Aggrobot manufactured by Hosokawa Micron Corporation. A specific measurement method is as described below.

1) In the Case of Magnetic Toner

Figure 2A:
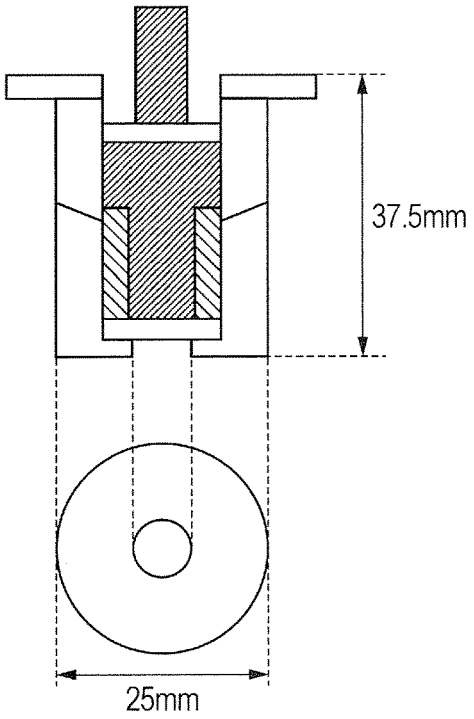
FIG. 2A is an illustration of an example of an apparatus for measuring an inter-particle force to be used in the present invention.
Figure 2B:
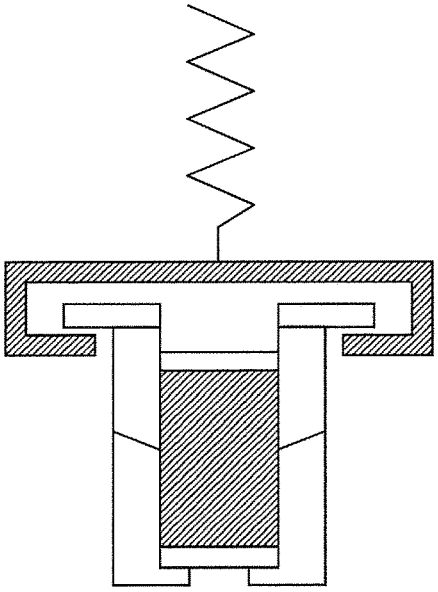
FIG. 2B is an illustration of an example of the apparatus for measuring an inter-particle force to be used in the present invention.

Under a 25° C./50% environment, 9.2 g of the toner is loaded into a vertically separating cylindrical cell illustrated in FIG. 2A. After that, a load bar is lowered at 0.1 mm/sec to apply a vertical load of 78.5 N or 157.0 N, to thereby form a consolidated toner layer (consolidated body of the toner). After that, as illustrated in FIG. 2B, the upper cell is lifted with a spring at a speed of 0.4 mm/sec to pull the toner layer (consolidated body of the toner), and an inter-particle force is calculated based on the maximum tensile fracture force at fracture of the toner layer (consolidated body of the toner).

It should be noted that the cylindrical cell has an inner diameter of 25 mm and a height of 37.5 mm.

2) In the Case of Non-Magnetic Toner

Under a 25° C./50% environment, 7.7 g of the toner is loaded into a vertically separating cylindrical cell illustrated in FIG. 2A. After that, a load bar is lowered at 0.1 mm/sec to apply a vertical load of 78.5 N or 157.0 N, to thereby form a consolidated toner layer (consolidated body of the toner). After that, as illustrated in FIG. 2B, the upper cell is lifted with a spring at a speed of 0.4 mm/sec to pull the toner layer (consolidated body of the toner), and an inter-particle force is calculated based on the maximum tensile fracture force at fracture of the toner layer (consolidated body of the toner).

It should be noted that the cylindrical cell has an inner diameter of 25 mm and a height of 37.5 mm.

<Measurement of Saturated Moisture Adsorption Amount of Silica Fine Particles A>

The saturated moisture adsorption amount of the silica fine particles A is measured using TGA Q5000SA (manufactured by TA Instruments). The measurement is performed by the following procedure.

As a sample, 5 mg to 20 mg of the silica fine particles A are weighed in a sample pan, which is then set in the main body of TGA Q5000SA. Measurement is performed under the measurement conditions of: a temperature of 32.5° C. and a humidity of 0% for 2 hours; then a temperature of 32.5° C. and a humidity of 80% for 2 hours; and then again a temperature of 32.5° C. and a humidity of 0% for 2 hours. A difference between a moisture amount after standing at a temperature of 32.5° C. and a humidity of 0% for 2 hours from the initiation of the measurement and a moisture amount after standing at 32.5° C. and a humidity of 80% for 2 hours is defined as the saturated moisture adsorption amount.

Now, the present invention is described more specifically by way of Examples. However, the embodiments of the present invention are by no means limited to Examples below. In Examples, "part(s)" refers to "part(s) by mass".

<Production of Toner Carrier>

Figure 5:
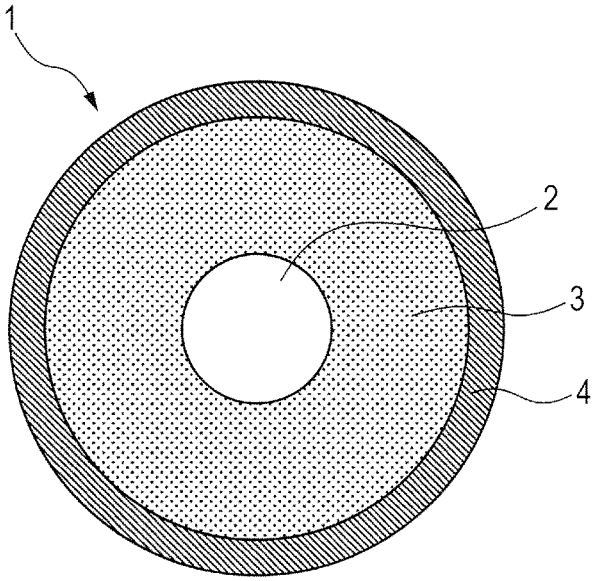
FIG. 5 is a schematic view for illustrating an example of the construction of a toner carrier.

The production of a toner carrier is described with reference to FIG. 5.

(Synthesis of Isocyanate Group-Terminated Prepolymer A-1)

Under a nitrogen atmosphere, in a reaction vessel, to 17.7 parts of tolylene diisocyanate (TDI) (trade name: COSMONATE T80; manufactured by Mitsui Chemicals, Inc.), 100.0 g of a polypropylene glycol-based polyol (trade name: EXCENOL 4030; manufactured by Asahi Glass Co., Ltd.) was gradually added dropwise while the temperature in the reaction vessel was kept at 65° C. After the completion of the dropwise addition, a reaction was performed at a temperature of 65° C. for 2 hours. The resultant reaction mixture was cooled to room temperature to provide an isocyanate group-terminated prepolymer A-1 having an isocyanate group content of 3.8 mass %.

(Synthesis of Amino Compound (Compound Represented by Structural Formula (1)))

(Synthesis of Amino Compound B-1)

In a reaction vessel equipped with a stirring device, a temperature gauge, a reflux tube, a dropping device, and a temperature-controlling device, 100.0 parts (1.67 mol) of ethylenediamine and 100 parts of pure water were warmed to 40° C. while being stirred. Next, while the reaction temperature was kept at 40° C. or less, 425.3 parts (7.35 mol) of propylene oxide was gradually added dropwise over 30 minutes. The mixture was subjected to a reaction by being further stirred for 1 hour to provide a reaction mixture. The resultant reaction mixture was heated under reduced pressure to evaporate water. Thus, 426 g of an amino compound B-1 was obtained.

Structural formula (1)

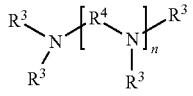

(Preparation of Substrate)

A substrate 2 was prepared by applying and baking a primer (trade name, DY35-051; manufactured by Dow Corning Toray Co., Ltd.) onto an aluminum cylindrical tube having an outer diameter of 10 mmϕ (diameter) and an arithmetic average roughness Ra of 0.2 μm, which had been subjected to grinding processing.

(Production of Elastic Roller)

The substrate prepared in the foregoing was placed in a die, and an addition-type silicone rubber composition obtained by mixing the following materials was injected into a cavity formed in the die.

| | |
|---|---|
| Liquid silicone rubber material (trade name, SE 6724 A/B; manufactured by Dow Corning Toray Co., Ltd.) | 100 parts |
| Carbon black (trade name, TOKABLACK #4300; manufactured by Tokai Carbon Co., Ltd.) | 15 parts |
| Silica powder as a heat resistance-imparting agent | 0.2 part |
| Platinum catalyst | 0.1 part |

Subsequently, the die was heated to vulcanize and cure the silicone rubber at a temperature of 150° C. for 15 minutes. The substrate having a cured silicone rubber layer formed on the peripheral surface thereof was removed from the die, and then the substrate was further heated at a temperature of 180° C. for 1 hour to complete the curing reaction of the silicone rubber layer. Thus, an elastic roller D-2 having a silicone rubber elastic layer 3 having a thickness of 0.5 mm and a diameter of 11 mm formed on the outer periphery of the substrate 2 was produced.

(Production of Surface Layer)

As materials for a surface layer 4, 617.9 parts of the isocyanate group-terminated prepolymer A-1 was stirred and mixed with 34.2 parts of the amino compound B-1, 117.4 parts of carbon black (trade name, MA230; manufactured by Mitsubishi Chemical Corporation), and 130.4 parts of urethane resin fine particles (trade name, Art Pearl C-400; manufactured by Negami Chemical Industrial Co., Ltd.).

Next, MEK was added so as to achieve a total solid content ratio of 30 mass %, to thereby prepare a paint for forming a surface layer.

Next, the elastic roller D-2 produced in advance was placed in a vertical position with its rubber-free portion masked, and was rotated at 1,500 rpm. The paint was applied thereto with a spray gun being lowered at 30 mm/s. Subsequently, the resultant was heated in a hot air drying furnace at a temperature of 180° C. for 20 minutes to cure and dry the applied layer, to thereby form a surface layer having a thickness of about 8 μm on the outer periphery of the elastic layer. Thus, a toner carrier 1 was produced.

<Production Example of Toner Particles 1>

(Preparation of First Aqueous Medium)

450 Parts of a 0.1 mol/L-$Na_3PO_4$ aqueous solution was fed into 720 parts of ion-exchanged water, and the mixture was warmed to a temperature of 60° C. After that, 67.7 parts of a 1.0 mol/L-$CaCl_2$ aqueous solution was added to provide a first aqueous medium containing a dispersion stabilizer.

(Preparation of Polymerizable Monomer Composition)

| | |
|---|---|
| Styrene | 74 parts |
| n-Butyl acrylate | 26 parts |
| Divinylbenzene | 0.5 part |
| Polyester resin | 10 parts |
| Negative charge control agent T-77 (manufactured by Hodogaya Chemical Co., Ltd.) | 1 part |
| Magnetic material (composition: $Fe_3O_4$, shape: spherical shape, number average particle diameter of primary particles: 0.21 μm, magnetic characteristics at 795.8 kA/m; Hc: 5.5 kA/m, σs: 84.0 $Am^2/kg$, σr: 6.4 A) | 65 parts |

The above-mentioned formulation was uniformly dispersed and mixed using an attritor (manufactured by Mitsui Miike Chemical Engineering Machinery, Co., Ltd.). The resultant monomer composition was warmed to a temperature of 60° C., and 15 parts of a paraffin wax (HNP-9: manufactured by Nippon Seiro Co., Ltd.) serving as a release agent and 10 parts of t-butyl peroxypivalate (25% toluene solution) serving as a polymerization initiator were mixed and dissolved therein to prepare a polymerizable monomer composition.

(Preparation of Second Aqueous Medium)

150 Parts of a 0.1 mol/L-$Na_3PO_4$ aqueous solution was fed into 360 parts of ion-exchanged water, and the mixture was warmed to a temperature of 60° C. After that, 22.6 parts of a 1.0 mol/L-$CaCl_2$ aqueous solution was added to provide a second aqueous medium containing a dispersion stabilizer.

(Granulation/Polymerization/Filtration/Drying)

The polymerizable monomer composition was fed into the first aqueous medium, and the mixture is granulated by being stirred at a temperature of 60° C. under a $N_2$ atmosphere with TK Homomixer (manufactured by Tokushu Kika Kogyo Co., Ltd.) at 10,000 rpm for 15 minutes. After that, the granulated liquid was added to the second aqueous medium, and the mixture is stirred with a paddle stirring blade to be subjected to a polymerization reaction at a reaction temperature of 70° C. for 300 minutes. After that, the suspension liquid was cooled at 3° C./min to room temperature, and hydrochloric acid was added to dissolve the dispersant, followed by filtration, water washing, and drying to provide toner particles 1. The physical properties of the toner particles 1 are as shown in Table 1.

<Production Example of Toner Particles 2>

Toner particles 2 were obtained by the same method as that for the toner particles 1 except that in "Production Example of Toner Particles 1", the number of rotations of the stirring with TK Homomixer (manufactured by Tokushu Kika Kogyo Co., Ltd.) at the time of the granulation was changed to 12,000 rpm. The physical properties of the toner particles 2 are as shown in Table 1.

<Production Example of Toner Particles 3>

Toner particles 3 were obtained by the same method as that for the toner particles 1 except that in "Production Example of Toner Particles 1", the amount of the 0.1 mol/L-$Na_3PO_4$ aqueous solution to be added to the second aqueous medium was changed to 100 parts, and the amount of the 1.0 mol/L-$CaCl_2$ aqueous solution to be added was changed to 15.0 parts. The physical properties of the toner particles 3 are as shown in Table 1.

<Production Example of Toner Particles 4>

Toner particles 4 were obtained by the same method as that for the toner particles 1 except that in "Production Example of Toner Particles 1", the amount of the 0.1 mol/L-Na $PO_4$ aqueous solution to be added to the second aqueous medium was changed to 200 parts, and the amount of the 1.0 mol/L-$CaCl_2$ aqueous solution to be added was changed to 30.1 parts. The physical properties of the toner particles 4 are as shown in Table 1.

<Production Example of Toner Particles 5>

Toner particles 5 are obtained by the same method as that for the toner particles 1 except that in "Production Example of Toner Particles 1", the amount of the 0.1 mol/L-Na $PO_4$ aqueous solution to be added to the second aqueous medium is changed to 50 parts, and the amount of the 1.0 mol/L-$CaCl_2$ aqueous solution to be added is changed to 7.5 parts. The physical properties of the toner particles 5 are as shown in Table 1.

<Production Example of Toner Particles 6>

Toner particles 6 were obtained by the same method as that for the toner particles 1 except that in "Production Example of Toner Particles 4", the number of rotations of the stirring with TK Homomixer at the time of the granulation was changed to 12,000 rpm. The physical properties of the toner particles 6 are as shown in Table 1.

<Production Example of Toner Particles 9>

Toner particles 9 were obtained by the same method as that for the toner particles 1 except that in "Production Example of Toner Particles 1", the second aqueous medium was not used. The physical properties of the toner particles 9 are as shown in Table 1.

<Production Example of Toner Particles 7>

A four-necked vessel was loaded with 710 parts of ion-exchanged water and 850 parts of a 0.1 mol/L Na $PO_4$ aqueous solution, and the mixture was kept at 60° C. while being stirred at 12,000 rpm using TK Homomixer. 68 Parts of a 1.0 mol/L-$CaCl_2$ aqueous solution was gradually added to the mixture to prepare an aqueous dispersion medium containing a fine and poorly water-soluble dispersion stabilizer $Ca_3$ $(PO_4)_2$.

| | |
|---|---|
| Styrene | 76 parts |
| n-Butyl acrylate | 24 parts |
| C.I. Pigment Blue 15:3: manufactured by Dainichiseika Color & Chemicals Mfg. Co., Ltd. | 6.5 parts |
| Polyester-based resin (1) (terephthalic acid-propylene oxide-modified bisphenol A (2 mole adduct) (molar ratio = 51:50), acid value = 10 mgKOH/g, glass transition temperature = 70° C., Mw = 10,500, Mw/Mn = 3.20) | 5 parts |
| Negative chargeability control agent (aluminum compound of 3,5-di-tert-butylsalicylic acid) | 0.4 part |
| Fisher-Tropsch wax (maximum endothermic peak temperature = 75° C.) | 7.5 parts |

The above-mentioned materials were stirred for 3 hours using an attritor to disperse the components in the polymerizable monomers, to thereby prepare a monomer mixture. To the monomer mixture, 10.0 parts of 1,1,3,3-tetramethylbutyl peroxy-2-ethylhexanoate serving as a polymerization initiator (toluene solution 50%) was added to prepare a polymerizable monomer composition. The polymerizable monomer composition is fed into the aqueous dispersion medium, and the mixture was granulated for 5 minutes while the number of rotations of the stirring machine is maintained at 10,000 rpm. After that, the high-speed stirring device was changed to a propeller-type stirrer, the inner temperature was increased to 70° C., and a reaction was performed for 6 hours under slow stirring.

Next, the temperature in the vessel was increased to 80° C., and the temperature was maintained for 4 hours and then gradually cooled at a cooling speed of 1° C./min to 30° C. to provide a slurry 1. Dilute hydrochloric acid was added into the vessel containing the slurry 1 to remove the dispersion stabilizer. Further, the resultant was filtered, washed, and dried to provide toner particles 7. The physical properties of the toner particles 7 are as shown in Table 1.

<Production Example of Toner Particles 8>

71.0 Parts of polyoxypropylene(2.2)-2,2-bis(4-hydroxyphenyl)propane, 28.0 parts of terephthalic acid, 1.0 part of trimellitic anhydride, and 0.5 part of titanium tetrabutoxide were charged into a 4-L four-necked glass flask, and the flask was equipped with a temperature gauge, a stirring bar, a condenser, and a nitrogen inlet tube and placed in a mantle heater. Next, the inside of the flask was purged with nitrogen gas, the temperature was then gradually increased under stirring, and a reaction was performed for 4 hours at a temperature of 200° C. under stirring. Thus, a polyester resin 1-1 was obtained. The polyester resin 1-1 has the following physical properties: a weight average molecular weight (Mw) of 80,000, a number average molecular weight (Mn) of 3,500, and a peak molecular weight (Mp) of 5,700.

In addition, 70.0 parts of polyoxypropylene(2.2)-2,2-bis(4-hydroxyphenyl)propane, 20.0 parts of terephthalic acid, 3.0 parts of isophthalic acid, 7.0 parts of trimellitic anhydride, and 0.5 part of titanium tetrabutoxide were charged into a 4-L four-necked glass flask, and the flask was equipped with a temperature gauge, a stirring bar, a condenser, and a nitrogen inlet tube and placed in a mantle heater. Next, the inside of the flask was purged with nitrogen gas, the temperature was then gradually increased under stirring, and a reaction was performed for 6 hours at a temperature of 220° C. under stirring. Thus, a polyester resin 1-2 was obtained. The polyester resin 1-2 has the following physical properties: a weight average molecular weight (Mw) of 120,000, a number average molecular weight (Mn) of 4,000, and a peak molecular weight (Mp) of 7,800.

70 Parts of the polyester resin 1-1 and 30 parts of the polyester resin 1-2 were premixed with a Henschel mixer (manufactured by Mitsui Miike Chemical Engineering Machinery, Co., Ltd.), and melt-blended with a melt-kneading machine (model PCM-30, manufactured by Ikegai Ironworks Corp.) under the conditions of a number of rotations of 3.3 $s^{-1}$ and a kneaded resin temperature of 100° C. to provide a binder resin 1.

| | |
|---|---|
| Low-density polyethylene (Mw: 1,400, Mn: 850, maximum endothermic peak by DSC: 100° C.) | 20.0 parts |
| Styrene | 64.0 parts |
| n-Butyl acrylate | 13.5 parts |
| Acrylonitrile | 2.5 parts |

Next, the above-mentioned materials were loaded into an autoclave, the inside of the system was purged with $N_2$, and then the temperature was increased and kept at 180° C. under stirring. 50 Parts of a solution of 2 mass % t-butyl hydroperoxide in xylene was continuously added dropwise into the system for 5 hours, the mixture was cooled, and then the solvent was separated and removed to provide a polymer A. The molecular weight of the polymer A is measured and found to be 7,000 in terms of weight average molecular weight (Mw) and 3,000 in terms of number average molecular weight (Mn).

| | |
|---|---|
| Binder resin 1 | 100 parts |
| Polymer A | 5 parts |
| Fisher-Tropsch wax (peak temperature of maximum endothermic peak: 78° C.) | 5 parts |
| C.I. Pigment Blue 15:3: manufactured by Dainichiseika Color & Chemicals Mfg. Co., Ltd. | 8 parts |
| Negative chargeability control agent (aluminum compound of 3,5-di-tert-butylsalicylic acid) | 0.5 part |

Next, the above-mentioned formulation was mixed with a Henschel mixer (model FM-75, manufactured by Mitsui Miike Chemical Engineering Machinery, Co., Ltd.), and then kneaded with a biaxial kneader (model PCM-30, manufactured by Ikegai Ironworks Corp.) set to a temperature of 130° C. The kneaded product was cooled and coarsely pulverized with a hammer mill to 1 mm or less to provide a coarsely pulverized product. The obtained coarsely pulverized product was pulverized with a mechanical pulverizing machine (T-250, manufactured by Turbo Kogyo Co., Ltd.). Further, the resultant was classified with a multi-grade classifying machine utilizing the Coanda effect to provide resin particles.

The resin particles were subjected to heat sphering treatment. The heat sphering treatment was performed using Surfusing System (manufactured by Nippon Pneumatic Mfg. Co., Ltd.) to provide toner particles 8. The operation conditions of the heat sphering apparatus are set as follows: feed rate=5 kg/hr, hot air temperature=250° C., hot air flow rate=6 $m^3$/min, cold air temperature=5° C., cold air flow rate=4 $m^3$/min, absolute moisture content of cold air=3 g/$m^3$, blower air rate=20 $m^3$/min, injection air flow rate=1 $m^3$/min, diffusing air=0.3 $m^3$/min.

The physical properties of the toner particles 8 thus obtained are as shown in Table 1.

<Production Example of Toner Particles 10>

In "Production Example of Toner Particles 8", instead of performing the heat sphering treatment, the following apparatus was used. A simultaneous mechanical classifying and sphering treatment apparatus (Faculty, manufactured by Hosokawa Micron Corporation) was used to perform surface treatment for 60 seconds at a number of rotations of a dispersion rotor of 100 $s^{-1}$ (peripheral speed of rotation: 130 m/sec) while removing fine particles at a number of rotations of a classification rotor of 120 $s^{-1}$ to provide toner particles 10. The physical properties of the toner particles 10 thus obtained are as shown in Table 1.

<Production Example of Toner Particles 11>

Production of Resin Dispersion Liquid:

| | |
|---|---|
| Styrene | 78.0 parts |
| n-Butyl acrylate | 20.0 parts |
| Dodecanethiol | 6.0 parts |
| Methacrylic acid | 2.0 parts |
| Carbon tetrabromide | 1.0 part |

In a flask, 1.5 parts of a nonionic surfactant Nonipol 400 and 2.5 parts of an anionic surfactant Neogen SC were dissolved in 140 parts of ion-exchanged water. A product obtained by mixing and dissolving the above-mentioned materials was dispersed and emulsified in the flask, and while being slowly mixed for 10 minutes, the resultant was fed with 10 parts of ion-exchanged water having dissolved therein 1.0 part of ammonium persulfate. While nitrogen purging was performed, the flask was heated in an oil bath until the temperature of the contents reaches 70° C., and emulsion polymerization was continued under that state for 5 hours. Thus, a resin dispersion liquid having a median diameter of 145 nm, a glass transition point of 58° C., and a Mw of 11,200 is obtained.

Preparation of Cyan Pigment Dispersion Liquid: The following composition was mixed and dissolved, and dispersed by means of a homogenizer (IKA ULTRA-TURRAX) and ultrasonic irradiation to provide a cyan pigment dispersion liquid having a median particle diameter of 140 nm.

| | |
|---|---|
| Copper phthalocyanine (C.I. Pigment Blue 15:3: manufactured by Dainichiseika Color & Chemicals Mfg. Co., Ltd.) | 100.0 parts |
| Anionic surfactant Neogen SC | 10.0 parts |
| Ion-exchanged water | 400.0 parts |

Preparation of Release Agent Dispersion Liquid: The following composition was mixed and heated to 97° C., and then dispersed with ULTRA-TURRAX T50 manufactured by IKA. After that, the resultant was subjected to dispersion treatment with a Gaulin homogenizer (manufactured by Meiwa Shoji Co., Ltd.), and treated 20 times under the conditions of 105° C. and 550 kg/$cm^2$ to provide a release agent dispersion liquid having a median diameter of 190 nm.

| | |
|---|---|
| Paraffin wax (HNP-7: manufactured by Nippon Seiro Co., Ltd.) | 100.0 parts |
| Anionic surfactant Neogen SC | 5.0 parts |
| Ion-exchanged water | 300.0 parts |

Production of Toner Particles:

| | |
|---|---|
| Resin dispersion liquid (resin particle solid content: 25.0 mass %) | 400.0 parts |
| Colorant dispersion liquid | 33.6 parts |
| Release agent dispersion liquid | 30.0 parts |
| SANISOL B-50 | 2.0 parts |

The above-mentioned materials were mixed and dispersed in a round stainless-steel flask with ULTRA-TURRAX T50, and then the flask was heated to 48° C. in a heating oil bath under stirring. After having been kept at 48° C. for 30 minutes, the temperature of the heating oil bath was further increased and kept at 50° C. for 1 hour. After that, 3 parts of Neogen SC was added thereto, and then the stainless-steel flask was sealed and heated to 105° C. while stirring was continued using a magnetic seal. This state is kept for 3 hours. After cooling, the resultant was filtered and sufficiently washed with ion-exchanged water, and then dried and classified to provide toner particles 11. The physical properties of the toner particles 11 thus obtained are as shown in Table 1.

TABLE 1

| Toner particles | Particle diameter (μm) | Average circularity (—) | Aspect ratio |
|---|---|---|---|
| Toner particles 1 | 8.0 | 0.979 | 0.925 |
| Toner particles 2 | 7.9 | 0.976 | 0.926 |
| Toner particles 3 | 7.9 | 0.971 | 0.910 |
| Toner particles 4 | 8.1 | 0.981 | 0.931 |
| Toner particles 5 | 8.0 | 0.976 | 0.895 |
| Toner particles 6 | 8.1 | 0.986 | 0.935 |
| Toner particles 7 | 6.5 | 0.977 | 0.920 |
| Toner particles 8 | 6.6 | 0.961 | 0.860 |
| Toner particles 9 | 8.2 | 0.979 | 0.890 |
| Toner particles 10 | 6.7 | 0.944 | 0.840 |
| Toner particles 11 | 6.5 | 0.968 | 0.865 |

<Production Examples of Silica Fine Particles A>

<Production Example of Silica Fine Particles A-1>

Silica fine particles A-1 were produced by a sol-gel method.

A 3-L glass reactor equipped with a stirring machine, a dropping funnel, and a temperature gauge was loaded with 687.9 g of methanol, 42.0 g of pure water, and 47.1 g of 28 mass % ammonia water, and the contents were mixed. The resultant solution was adjusted to 35° C., and while the solution was stirred, 1,100.0 g (7.23 mol) of tetramethoxysilane and 395.2 g of 5.4 mass % ammonia water were simultaneously added. Tetramethoxysilane and ammonia water were added dropwise over 5 hours and 4 hours, respectively. Even after the completion of the dropwise addition, stirring was continued for an additional 0.2 hour to perform hydrolysis. Thus, a suspension liquid of hydrophilic spherical sol-gel silica fine particles was obtained.

After that, the pH of the suspension liquid thus prepared was adjusted to about 3.5. After the adjustment, the reactor was heated to 75° C., and while the contents in the reactor were stirred, a solution of 8.8 g of octyltriethoxysilane in 220 mL of isopropyl alcohol was added dropwise. After the dropwise addition, stirring was continued for 5 hours.

After the completion of the stirring, the resultant was cooled to room temperature and filtered. The residue was washed with ion-exchanged water, and then dried by heating at 120° C. overnight. After that, crushing was performed with a pulverizer (manufactured by Hosokawa Micron Corporation) to provide the silica fine particles A-1 of interest.

<Production Example of Silica Fine Particles A-2 to A-16>

Silica fine particles A-2 to A-16 were obtained in the same manner as the silica fine particles A-1 except that the reaction temperature of the sol-gel silica fine particles, the dropwise addition times of tetramethoxysilane and ammonia water, the pH of the methanol-water dispersion liquid, the kind of the surface treatment agent to be added, and the amount of the surface treatment agent were changed.

<Production Examples of Silica Fine Particles B>

<Production Example of Silica Fine Particles B-1>

Base material silica (fumed silica having a number average particle diameter of primary particles of 15 nm) was fed into an autoclave equipped with a stirring machine, and heated at 200° C. under a fluidized state achieved by stirring.

The inside of the reactor is purged with nitrogen gas and the reactor was sealed. Then, 25 parts of hexamethyldisilazane with respect to 100 parts of the base material silica was sprayed into the reactor to treat the silica in a fluidized state with the silane compound. The reaction was continued for 60 minutes, and then the reaction is completed. After the completion of the reaction, the pressure in the autoclave was released, and washing was performed with a stream of nitrogen gas to remove excess hexamethyldisilazane and a byproduct from hydrophobic silica.

Further, while hydrophobic silica in the reaction tank was stirred, 10 parts of a dimethyl silicone oil (viscosity=100 $mm^2$/sec) was sprayed with respect to 100 parts of the base material silica, and stirring was continued for 30 minutes. After that, the temperature was increased to 300° C. under stirring, and stirring was performed for an additional 2 hours. After that, the resultant was taken out and subjected to crushing to provide silica fine particles B-1.

<Production Example of Silica Fine Particles B-2 to B-7>

Silica fine particles B-2 to B-7 were obtained in the same manner as in "Production Example of Silica Fine Particles B-1" except that the particle diameter of untreated silica to be used was changed and the amount of the surface treatment agent was adjusted as appropriate.

Example 1

Production of Toner

Into 100 parts of the toner particles 1, 0.3 part of the silica fine particles A-1 was externally added and mixed with a Henschel mixer. After that, a toner was taken out, and the toner and 0.6 part of the silica fine particles B-1 were subjected to external addition and mixing with the apparatus illustrated in FIG. 3. In order to uniformly mix the toner particles and the silica fine particles B-1, first mixing was performed. The first mixing was performed under the conditions of a power of the driving member 38 of 0.10 W/g (number of rotations of the driving member 38: 150 rpm) and a treatment time of 1 minute. After that, a second mixing step was performed to provide a particle mixture. The power and the operation time in the second mixing step were 0.3 W/g (1,200 rpm) and minutes, respectively. It should be noted that with regard to the construction of the apparatus illustrated in FIG. 3, in the apparatus used, the diameter of the inner periphery of the main body casing 31 was 130 mm and the volume of the treatment space 39 was $2.0\times10^{-3}$ $m^3$, the rated power of the driving member 38 was set to 5.5 kW, and the shape illustrated in FIG. 6 was adopted as the shape of each of the stirring members 33. In addition, the overlapping width "d" of the stirring members 33*a* and the stirring members 33*b* in FIG. 6 was set to 0.25D with respect to the maximum width "D" of the stirring members 33, and the clearance between each of the stirring members 33 and the inner periphery of the main body casing 31 was set to 3.0 mm.

After the external addition and mixing treatment, the resultant was sieved with a mesh having an opening of 200 μm to provide a negatively triboelectrically chargeable toner 1. The physical properties of the silica fine particles A-1 and the silica fine particles B-1 on the toner, which are obtained from the toner 1, and various physical properties of the toner 1 are shown in Table 2.

Next, the following evaluations are performed using the toner 1. The evaluation results are shown in Table 3.

<Image-Forming Apparatus>

1) In the Case of Magnetic Toner

A printer LBP3100 manufactured by Canon Inc. was reconstructed and used for image output evaluation. The reconstruction was performed so that as illustrated in FIG. 1B, the toner carrier (FIG. 1B; 102) was brought into contact with the electrostatic latent image-bearing member (FIG. 1B: 100). It should be noted that the toner carrier was reduced in diameter so as to have an outer diameter of from 10 mm to 8 mm, and an abutment pressure was adjusted so that the abutment portion of the electrostatic latent image-bearing member is 0.8 mm. Further, a cleaner member (FIG. 1B; 116) for recovering a transfer residual toner, a fogging toner, paper powder, and the like was removed. In addition, as a result of the reduction in diameter of the toner carrier and the reduction in abutment portion area with the regulating portion, the evaluation conditions are severe for fogging on the drum after white image output in the regulating portion. Further, the toner adheres to the charging roller due to the absence of any cleaner portion, and hence charging performance was changed to establish severe conditions for developability, such as an image density.

The thus reconstructed developing apparatus was loaded with 40 g of the magnetic toner 1 to produce a developing apparatus. Image output is performed on 3,000 sheets using the produced developing apparatus under a high-temperature and high-humidity environment (temperature: 32.5° C./relative humidity: 80% RH). It should be noted that the image output test is performed in an intermittent mode of 2 sheets/6 seconds using, as an image, a horizontal line having a print percentage of 1%.

In addition, in the case of using a non-magnetic toner for evaluation in Examples and Comparative Examples described later, the following image-forming apparatus was used.

2) In the Case of Non-Magnetic Toner

A printer LBP7200C manufactured by Canon Inc. was reconstructed and used for image output evaluation. The reconstruction was performed in the same manner as in the reconstruction of LBP3100 used for the magnetic toner.

The thus reconstructed developing apparatus was loaded with 40 g of toner to produce a developing apparatus. The produced developing apparatus was mounted to the cyan station of the printer, dummy cartridges are mounted to the other stations, and image output evaluation was performed. Image output was performed on 3,000 sheets using the developing apparatus under a high-temperature and high-humidity environment (temperature: 32.5° C./relative humidity: 80% RH). It should be noted that the image output test was performed in an intermittent mode of 2 sheets/6 seconds using, as an image, a horizontal line having a print percentage of 1%.

In addition, after the image output on 3,000 sheets, under a high-temperature and high-humidity environment (32.5° C., relative humidity: 80% RH), the power source of the image-forming apparatus was turned off and the image-forming apparatus under this state was left to stand for 1 month. After that, the image-forming apparatus was restarted, and a chart obtained by forming a solid white image over the entire surface of printing paper was output on one sheet.

An evaluation method for each evaluation to be performed in Examples and Comparative Examples of the present invention and evaluation criteria therefor are described below.

<Image Density>

For an image density, a solid image portion was formed and the density of the solid image was measured with a Macbeth reflection densitometer (manufactured by Macbeth). Evaluation criteria for the reflection densities of solid images at the initial stage of endurance (evaluation 1) and after 3,000-sheet printing (evaluation 2) are as follows.

A: Extremely excellent (1.46 or more)

B: Excellent (1.41 or more and 1.45 or less)

C: Satisfactory (1.36 or more and 1.40 or less)

D: Poor (1.35 or less)

<Fogging on Drum after White Image Output>

Fogging is measured using REFLECTMETER MODEL TC-6DS manufactured by Tokyo Denshoku Co., Ltd. As a filter, a green filter was used. Fogging on the drum after white image output was calculated by taping the drum before the transfer of a solid white image with a Mylar tape, and subtracting the Macbeth density of a Mylar tape attached onto unused paper from the reflectance of paper having attached thereonto a Mylar tape.

It should be noted that evaluation timing was as follows: after image output on the first sheet immediately after the start of the printer (initial stage) and 3,000-sheet image output, the power source of the printer was temporarily turned off and fogging on the drum on the day after the first sheet (3,000th sheet) was evaluated. Further, the first sheet after long-term storage of 1 month after the 3,000-sheet image output was evaluated. Fogging (reflectance) (%)=reflectance on standard paper (%)-reflectance of non-image portion of sample (%)

A: Less than 5.0% (extremely excellent in suppression of fogging)

B: 5.0% or more and less than 10.0% (excellent in suppression of fogging)

C: 10.0% or more and less than 20.0% (satisfactory in suppression of fogging)

D: 20.0% or more (poor in suppression of fogging)

TABLE 2

| | | Silica fine particles A | | | | | Silica fine particles B | | |
|---|---|---|---|---|---|---|---|---|---|
| Toner kind | Toner particles | Kind | Part (s) by mass | Particle diameter of silica fine particles A on toner (nm) | Half width in weight-based particle size distribution (nm) | Saturated moisture adsorption amount (mass %) | Kind | Part (s) by mass | Particle diameter of silica fine particles B on toner (nm) |
| 1 | 1 | A-1 | 0.3 | 114 | 8.7 | 0.72 | B-1 | 0.6 | 15 |
| 2 | 2 | A-1 | 0.3 | 116 | 8.8 | 0.75 | B-2 | 0.6 | 18 |
| 3 | 2 | A-2 | 0.3 | 117 | 10.1 | 0.88 | B-3 | 0.6 | 24 |
| 4 | 3 | A-1 | 0.5 | 115 | 8.6 | 0.76 | B-1 | 0.6 | 16 |
| 5 | 1 | A-3 | 0.3 | 106 | 14.5 | 0.68 | B-1 | 0.6 | 14 |
| 6 | 1 | A-4 | 0.4 | 135 | 22.0 | 1.20 | B-1 | 0.6 | 15 |
| 7 | 1 | A-5 | 0.2 | 86 | 15.0 | 1.00 | B-1 | 0.6 | 16 |
| 8 | 1 | A-2 | 0.2 | 115 | 10.4 | 0.90 | B-1 | 0.6 | 14 |
| 9 | 1 | A-6 | 0.4 | 100 | 20.0 | 0.39 | B-1 | 0.6 | 15 |
| 10 | 5 | A-7 | 0.5 | 101 | 25.5 | 3.10 | B-1 | 0.6 | 13 |
| 11 | 1 | A-8 | 0.5 | 102 | 26.3 | 1.35 | B-1 | 0.6 | 14 |
| 12 | 4 | A-9 | 0.5 | 105 | 28.0 | 1.01 | B-1 | 0.6 | 16 |
| 13 | 5 | A-10 | 0.2 | 71 | 20.0 | 1.43 | B-1 | 0.6 | 17 |
| 14 | 6 | A-11 | 1.0 | 208 | 26.0 | 3.10 | B-1 | 0.8 | 18 |
| 15 | 7 | A-7 | 0.2 | 101 | 25.5 | 3.10 | B-1 | 0.5 | 14 |
| 16 | 8 | A-7 | 2.0 | 103 | 25.3 | 3.08 | B-1 | 0.6 | 18 |
| 17 | 5 | A-12 | 0.5 | 99 | 29.3 | 6.74 | B-1 | 0.6 | 15 |
| 18 | 9 | — | — | — | — | — | B-4 | 0.6 | 18 |
| 19 | 7 | — | — | — | — | — | B-5 | 1.0 | 25 |
| 20 | 5 | A-13 | 1.0 | 249 | 27.0 | 5.68 | B-1 | 0.6 | 17 |
| 21 | 10 | A-14 | 2.0 | 113 | 7.9 | 0.84 | B-6 | 0.3 | 20 |
| 22 | 11 | A-14 | 2.0 | 112 | 8.1 | 0.86 | B-6 | 0.3 | 20 |
| 23 | 11 | A-15 | 3.0 | 100 | 34.1 | 4.60 | B-7 | 0.5 | 40 |
| 24 | 10 | A-16 | 1.0 | 101 | 30.0 | 6.88 | B-8 | 0.8 | 27 |

TABLE 2-continued

| Toner kind | External addition condition First stage | External addition condition Second stage | Silica coverage ratio (%) | Formula (1) | Formula (2) |
|---|---|---|---|---|---|
| 1 | Henschel mixer Peripheral speed: 44 m/sec × 5 min | Construction of FIG. 3 0.3 W/g × 5 min | 55 | 15.9 | 0.33 |
| 2 | Henschel mixer Peripheral speed: 44 m/sec × 5 min | Construction of FIG. 3 0.3 W/g × 5 min | 51 | 11.8 | 0.42 |
| 3 | Henschel mixer Peripheral speed: 44 m/sec × 5 min | Construction of FIG. 3 0.3 W/g × 5 min | 55 | 13.8 | 0.43 |
| 4 | Henschel mixer Peripheral speed: 44 m/sec × 5 min | Construction of FIG. 3 0.3 W/g × 5 min | 50 | 19.0 | 0.37 |
| 5 | Henschel mixer Peripheral speed: 44 m/sec × 5 min | Construction of FIG. 3 0.3 W/g × 5 min | 55 | 19.8 | 0.44 |
| 6 | Henschel mixer Peripheral speed: 44 m/sec × 5 min | Construction of FIG. 3 0.3 W/g × 5 min | 52 | 24.5 | 0.46 |
| 7 | Henschel mixer Peripheral speed: 44 m/sec × 5 min | Construction of FIG. 3 0.3 W/g × 5 min | 54 | 18.0 | 0.56 |
| 8 | Henschel mixer Peripheral speed: 44 m/sec × 5 min | Construction of FIG. 3 0.3 W/g × 5 min | 46 | 24.0 | 0.57 |
| 9 | Henschel mixer Peripheral speed: 44 m/sec × 5 min | Construction of FIG. 3 0.3 W/g × 5 min | 58 | 21.5 | 0.46 |
| 10 | Henschel mixer Peripheral speed: 44 m/sec × 5 min | Construction of FIG. 3 0.3 W/g × 5 min | 56 | 23.5 | 0.49 |
| 11 | Henschel mixer Peripheral speed: 44 m/sec × 5 min | Construction of FIG. 3 0.3 W/g × 5 min | 57 | 24.5 | 0.51 |
| 12 | Henschel mixer Peripheral speed: 44 m/sec × 5 min | Construction of FIG. 3 0.3 W/g × 5 min | 56 | 24.8 | 0.55 |
| 13 | Henschel mixer Peripheral speed: 44 m/sec × 5 min | Construction of FIG. 3 0.3 W/g × 5 min | 53 | 22.8 | 0.58 |
| 14 | Henschel mixer Peripheral speed: 44 m/sec × 5 min | Construction of FIG. 3 0.3 W/g × 5 min | 48 | 24.5 | 0.59 |
| 15 | Henschel mixer Peripheral speed: 44 m/sec × 5 min | Construction of FIG. 3 0.3 W/g × 5 min | 39 | 24.0 | 0.59 |
| 16 | Henschel mixer Peripheral speed: 44 m/sec × 5 min | Construction of FIG. 3 0.3 W/g × 5 min | 40 | 24.9 | 0.56 |
| 17 | Henschel mixer Peripheral speed: 44 m/sec × 5 min | Construction of FIG. 3 0.3 W/g × 5 min | 55 | 26.0 | 0.58 |
| 18 | — | Construction of FIG. 3 0.3 W/g × 5 min | 48 | 13.8 | 1.10 |

TABLE 2-continued

| | | | | | |
|---|---|---|---|---|---|
| 19 | — | Henschel mixer Peripheral speed: 44 m/sec × 5 min | 60 | 6.7 | 1.70 |
| 20 | Henschel mixer Peripheral speed: 44 m/sec × 5 min | Construction of FIG. 3 0.3 W/g × 5 min | 50 | 20.0 | 0.65 |
| 21 | Construction of FIG. 3 0.3 W/g × 5 min | Construction of FIG. 3 0.3 W/g × 5 min | 47 | 17.5 | 0.80 |
| 22 | Henschel mixer Peripheral speed: 44 m/sec × 5 min | Henschel mixer Peripheral speed: 44 m/sec × 5 min | 49 | 10.0 | 0.69 |
| 23 | Henschel mixer Peripheral speed: 44 m/sec × 5 min | Henschel mixer Peripheral speed: 44 m/sec × 5 min | 51 | 13.0 | 0.63 |
| 24 | Henschel mixer Peripheral speed: 44 m/sec × 5 min | Henschel mixer Peripheral speed: 44 m/sec × 5 min | 40 | 25.6 | 1.00 |

Examples 2 to 16

A toner 2 to a toner 16 were obtained in the same manner as in the production example of the toner 1 except that the toner particles, the silica fine particles A, and the silica fine particles B, and their numbers of parts by mass were changed. The physical properties of the silica fine particles A and the silica fine particles B on the toners, which are obtained from the toner 2 to the toner 16, and various physical properties of the toners are shown in Table 2. Further, the results of evaluations performed in the same manner as in Example 1 are shown in Table 3.

Comparative Examples 1 to 8

A toner 17 to a toner 24 were obtained in the same manner as in the production example of the toner 1 except that the toner particles, the silica fine particles A, and the silica fine particles B, and their numbers of parts by mass were changed. The physical properties of the silica fine particles A and the silica fine particles B on the toners, which are obtained from the toner 17 to the toner 24, and various physical properties of the toners are shown in Table 2. Further, the results of evaluations performed in the same manner as in Example 1 are shown in Table 3.

TABLE 3

| | | High-temperature and high-humidity environment | | | | | | | | | |
|---|---|---|---|---|---|---|---|---|---|---|---|
| | | Image density | | | | First fogging in the morning on drum after white image output | | | | First fogging in the morning on drum after white image output after long-term storage | |
| | Toner kind | Initial stage | | 3,000 sheets | | Initial stage | | 3,000 sheets | | | |
| Example 1 | Toner 1 | 1.54 | A | 1.52 | A | 2.4 | A | 2.9 | A | 3.4 | A |
| Example 2 | Toner 2 | 1.55 | A | 1.51 | A | 2.0 | A | 3.5 | A | 4.5 | A |
| Example 3 | Toner 3 | 1.51 | A | 1.46 | A | 2.6 | A | 4.6 | A | 6.5 | B |
| Example 4 | Toner 4 | 1.50 | A | 1.48 | A | 4.9 | A | 6.5 | B | 7.5 | B |
| Example 5 | Toner 5 | 1.50 | A | 1.46 | A | 5.5 | B | 7.5 | B | 9.4 | B |
| Example 6 | Toner 6 | 1.45 | B | 1.44 | B | 6.2 | B | 9.1 | B | 9.9 | B |
| Example 7 | Toner 7 | 1.50 | A | 1.42 | B | 4.5 | A | 8.5 | B | 10.5 | C |
| Example 8 | Toner 8 | 1.44 | B | 1.41 | B | 6.0 | B | 9.9 | B | 12.2 | C |
| Example 9 | Toner 9 | 1.49 | A | 1.44 | B | 5.7 | B | 10.0 | C | 11.5 | C |
| Example 10 | Toner 10 | 1.44 | B | 1.41 | B | 7.4 | B | 12.5 | C | 14.4 | C |
| Example 11 | Toner 11 | 1.43 | B | 1.40 | C | 6.3 | B | 9.3 | B | 12.0 | C |
| Example 12 | Toner 12 | 1.41 | B | 1.38 | C | 7.0 | B | 9.4 | B | 12.9 | C |
| Example 13 | Toner 13 | 1.48 | A | 1.40 | C | 6.0 | B | 10.4 | C | 16.0 | C |
| Example 14 | Toner 14 | 1.40 | C | 1.36 | C | 8.5 | B | 12.6 | C | 16.8 | C |
| Example 15 | Toner 15 | 1.40 | C | 1.36 | C | 9.0 | B | 13.1 | C | 17.3 | C |
| Example 16 | Toner 16 | 1.40 | C | 1.36 | C | 9.4 | B | 12.4 | C | 17.4 | C |
| Comparative Example 1 | Toner 17 | 1.44 | B | 1.37 | C | 13.0 | C | 19.9 | C | 22.4 | D |
| Comparative Example 2 | Toner 18 | 1.45 | B | 1.37 | C | 5.4 | B | 20.9 | D | 24.9 | D |
| Comparative Example 3 | Toner 19 | 1.41 | B | 1.33 | D | 5.0 | B | 20.0 | D | 24.4 | D |
| Comparative Example 4 | Toner 20 | 1.39 | C | 1.36 | C | 9.9 | B | 20.4 | D | 26.5 | D |
| Comparative Example 5 | Toner 21 | 1.42 | B | 1.34 | D | 8.4 | B | 20.4 | D | 26.4 | D |
| Comparative Example 6 | Toner 22 | 1.41 | B | 1.34 | D | 6.4 | B | 17.4 | C | 23.4 | D |

TABLE 3-continued

| | | High-temperature and high-humidity environment | | | | | | | | | |
|---|---|---|---|---|---|---|---|---|---|---|---|
| | | Image density | | | | First fogging in the morning on drum after white image output | | | First fogging in the morning on drum after white image output after long-term storage | | |
| | Toner kind | Initial stage | | 3,000 sheets | | Initial stage | | | 3,000 sheets | | |
| Comparative Example 7 | Toner 23 | 1.39 | C | 1.33 | D | 8.0 | B | 18.0 | C | 23.0 | D |
| Comparative Example 8 | Toner 24 | 1.38 | C | 1.30 | D | 17.0 | C | 29.0 | D | 35.5 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-231171, filed Nov. 14, 2014, and Japanese Patent Application No. 2015-205384, filed Oct. 19, 2015, which are hereby incorporated by reference herein in their entirety.

REFERENCE SIGNS LIST

1: toner carrier, 2: substrate, 3: elastic layer, 4: surface layer, 31: main body casing, 32: rotary member, 33, 33*a*, 33*b*: stirring member, 34: jacket, 35: raw material feed port, 36: product discharge port, 37: central axis, 38: driving member, 39: treatment space, 310: rotary member end portion side surface, 316: raw material feed port inner piece, 317: product discharge port inner piece, d: distance representing overlapping portion of stirring members, D: width of stirring member, 100: electrostatic latent image-bearing member (photosensitive member), 102: toner carrier, 114: transfer member (transfer charging roller), 116: cleaner member (waste toner container), 117: charging member (charging roller), 121: laser-generating apparatus (latent image-forming means, exposing apparatus), 123: laser light, 124: pickup roller, 125: conveyance belt, 126: fixing device, 140: developing device, 141: stirring member, 142: toner-regulating member, p: transfer material

What is claimed is:

1. A toner, comprising:

a toner particle containing a binder resin and a colorant; and an inorganic fine particle comprising a silica fine particle A, the silica fine particle A having (i) a number average particle diameter (D1) of a primary particle of 80 to 200 nm and (ii) a half width of a maximum peak in a weight-based particle size distribution of 15.0 nm or less, wherein the toner particle has an average circularity of 0.960 or more, and the toner satisfies formula (1) and formula (2):

$$Fp(A) \leq 25.0 \text{ nN} \quad (1)$$

$$(Fp(B)-Fp(A))/Fp(A) \leq 0.60 \quad (2)$$

in which Fp(A) represents an inter-particle force (nN) of the toner, which is measured by using a consolidated body of the toner prepared by compressing the toner with a load of 78.5 N; and Fp(B) represents an inter-particle force (nN) of the toner, which is measured by using a consolidated body of the toner prepared by compressing the toner with a load of 157.0 N.

2. A toner according to claim 1, wherein the silica fine particle A has a saturated moisture adsorption amount of 0.4 to 3.0 mass % after being left to stand under an environment having a temperature of 32.5° C. and a relative humidity of 80% for 2 hours.

3. A toner according to claim 1, wherein the inorganic fine particle further contains a silica fine particle B having a number average particle diameter (D1) of a primary particle of 5 nm to 20 nm.

4. A toner according to claim 1, wherein the colorant comprises a magnetic fine particle.

5. A toner according to claim 1, wherein the toner particle has an average circularity of 0.970 or more.

6. A toner according to claim 5, wherein the inorganic fine particle further contains a silica fine particle B having a number average particle diameter (D1) of a primary particle of 5 nm to 20 nm.

7. A toner according to claim 6, wherein the toner particle has an aspect ratio of 0.900 or more.

8. A toner according to claim 7, wherein the Fp(A) is 19.8 nN or less.

9. A toner according to claim 5, wherein the toner particle has an aspect ratio of 0.900 or more.

10. A toner according to claim 1, wherein the toner particle has an aspect ratio of 0.900 or more.

11. A toner according to claim 1, wherein the Fp(A) is 19.8 nN or less.

* * * * *